US010173804B2

(12) United States Patent
Zacherle

(10) Patent No.: US 10,173,804 B2
(45) Date of Patent: Jan. 8, 2019

(54) CARRIER AND BLANK THEREFOR

(71) Applicant: WestRock Packaging Systems, LLC, Norcross, GA (US)

(72) Inventor: Matthew E. Zacherle, Chesterfield, VA (US)

(73) Assignee: WestRock Packaging Systems, LLC, Atlanta, GA (US)

( * ) Notice: Subject to any disclaimer, the term of this patent is extended or adjusted under 35 U.S.C. 154(b) by 0 days.

(21) Appl. No.: 15/526,149

(22) PCT Filed: Nov. 11, 2015

(86) PCT No.: PCT/US2015/060135
§ 371 (c)(1),
(2) Date: May 11, 2017

(87) PCT Pub. No.: WO2016/077450
PCT Pub. Date: May 19, 2016

(65) Prior Publication Data

US 2017/0327266 A1 Nov. 16, 2017

Related U.S. Application Data

(60) Provisional application No. 62/078,720, filed on Nov. 12, 2014.

(51) Int. Cl.
*B65D 5/48* (2006.01)
*B65D 71/58* (2006.01)
(Continued)

(52) U.S. Cl.
CPC ..... *B65D 5/48016* (2013.01); *B65D 5/10* (2013.01); *B65D 5/4266* (2013.01); *B65D 5/443* (2013.01);
(Continued)

(58) Field of Classification Search
CPC .. B65D 5/48016; B65D 5/4608; B65D 5/443; B65D 5/48048; B65D 5/48014; B65D 5/48008; B65D 71/0022; B65D 71/0014
(Continued)

(56) References Cited

U.S. PATENT DOCUMENTS 3,989,181 A * 11/1976 Wilcox ..... B65D 5/06 229/117.17
4,148,427 A * 4/1979 Baker ..... B65D 5/48016 206/423

(Continued)

FOREIGN PATENT DOCUMENTS

FR 2718716 A1 10/1995
WO WO 2005/014408 2/2005

*Primary Examiner* — Steven A. Reynolds
(74) *Attorney, Agent, or Firm* — WestRock Intellectual Property Group

(57) ABSTRACT

A carrier (90) for packaging articles is formed from a single unitary blank (10). The carrier includes primary panels (14, 16, 18, 20) hingedly connected together to form a tubular structure having an interior space. A bottom closure structure (30*b*, 34*b*) at least partially closes a lower end of the tubular structure. At least one of the primary panels (16, 20) may include a handle (H1, H2). A handle reinforcing panel (30*a*, 34*a*) is secured to the inside surface of the at least one of the primary panels. A partition structure (P1, P2) is hingedly connected to the handle reinforcing panel and disposed in the tubular structure to divide the interior space of the tubular structure into two or more cells for receiving articles.

16 Claims, 21 Drawing Sheets

(51) Int. Cl.

| | |
|---|---|
| ***B65D 5/10*** | (2006.01) |
| ***B65D 5/44*** | (2006.01) |
| ***B65D 5/468*** | (2006.01) |
| ***B65D 5/42*** | (2006.01) |

(52) U.S. Cl.
CPC ..... *B65D 5/4608* (2013.01); *B65D 71/0022* (2013.01)

(58) Field of Classification Search
USPC ..... 206/139, 427; 229/120.18, 120.21
See application file for complete search history.

(56) References Cited

U.S. PATENT DOCUMENTS

| | | | | | |
|---|---|---|---|---|---|
| 4,179,061 | A * | 12/1979 | Gilbert | B65D 5/48014 | 229/117.16 |
| 4,293,091 | A * | 10/1981 | Gerard | B65D 5/48014 | 229/117.16 |
| 5,938,109 | A * | 8/1999 | Sainz | B65D 5/48014 | 229/120.11 |
| 6,112,977 | A * | 9/2000 | Sutherland | B65D 71/36 | 206/427 |
| 7,658,317 | B2 * | 2/2010 | Wilkins | B65D 5/725 | 206/427 |
| 2008/0237325 | A1 * | 10/2008 | Mittelstaedt | B65D 5/22 | 229/117.17 |
| 2012/0223129 | A1 | 9/2012 | Oppenheimer | | |
| 2014/0217102 | A1 * | 8/2014 | Wilson | B65D 5/48018 | 220/501 |
| 2017/0101211 | A1 * | 4/2017 | Lee | B65D 5/001 | |

* cited by examiner

CARRIER AND BLANK THEREFOR

TECHNICAL FIELD

The present invention relates to a carrier and to a blank for forming the carrier more specifically, but not exclusively, to a carrier formed from a foldable material in the style of an open top crate having a partition structure for dividing the carrier into cells.

BACKGROUND

In the field of packaging it is often required to provide consumers with a package comprising multiple primary product containers. Such multi-packs are desirable for shipping and distribution and for display of promotional information. For cost and environmental considerations, such cartons or carriers need to be formed from as little material as possible and cause as little wastage in the materials from which they are formed as possible. Another consideration is the strength of the packaging and its suitability for holding and transporting large weights of articles.

It is desirable to provide a carrier or carton with a partition structure to divide the carrier into cells each for accommodating an individual primary product container. In this way, each primary product container is separated or spaced from its adjacent neighbours and each primary product container is protected against "knocking damage" which can occur when adjacent primary product containers knock against one another when the package is moved. It is desirable to provide the carrier with a handle structure such that a consumer may readily transport the package; such handles should be strong enough to bear the load of the primary product containers. It is desirable to form such a carrier from a foldable sheet of material, preferably a recyclable material.

It is further beneficial to minimise the area and footprint of such a sheet of material in order to maximise the number of carriers that can be made from a standard sized sheet of material.

The present invention seeks to overcome or at least mitigate the problems of the prior art.

SUMMARY

According to a first aspect of the present invention there is provided a carrier for packaging a plurality of articles. The carrier is formed from a single unitary blank. The carrier comprises a plurality of primary panels hingedly connected together to form a tubular structure having an interior space. A bottom closure structure at least partially closes the lower end of the tubular structure. At least one of the primary panels may comprise a handle. A handle reinforcing panel is secured to the inside surface of the at least one of the primary panels. A partition structure is hingedly connected to the handle reinforcing panel and is disposed in the tubular structure to divide the interior space of the tubular structure into two or more cells for receiving articles.

Optionally, the handle reinforcing panel is hingedly connected to the at least one of the primary panels having the handle.

In some embodiments, the carrier comprises a first handle reinforcing panel hingedly connected to a first one of the primary panels and a second handle reinforcing panel hingedly connected to a second one of the primary panels.

Optionally, the first handle reinforcing panel comprises a first partition structure hingedly connected to the first handle reinforcing panel which divides the interior space of the tubular structure in a first direction.

Optionally, the second handle reinforcing panel comprises a second partition structure hingedly connected to the second handle reinforcing panel which divides the interior space of the tubular structure in the first direction.

In some embodiments, the carrier comprises a third partition structure which divides the interior space of the tubular structure in a second direction, the second direction being substantially perpendicular to the first direction.

The first and second partition structures may be secured to the third partition structure.

The partition structure may be automatically erectable within the carrier in response to erecting the carrier into a tubular structure.

Optionally, the unitary blank is formed from a foldable material.

Optionally, the partition structure is stuck at least in part from the handle reinforcing panel.

Optionally, the handle in the at least one of the primary panels is defined in part by a frangible line and a cushioning flap hingedly connected to the at least one of the primary panels and upon displacement of the cushioning flap out of the plane of the at least one of the primary panels a handle opening is formed in the at least one of the primary panels.

According to a second aspect of the present invention there is provided a single unitary blank for forming a carrier. The blank comprises a plurality of primary panels hingedly connected together for forming a tubular structure and a bottom closure structure for at least partially closing a lower end of the tubular structure. At least one of the primary panels has a handle. The blank further comprises a handle reinforcing panel for being secured to the inside surface of the at least one of the primary panels. A partition structure is hingedly connected to the handle reinforcing panel and is configured to be disposed in the tubular structure for dividing the interior space of the tubular structure of the carton into two or more cells for receiving articles when the blank is assembled into a carrier.

Optionally, the handle in the at least one of the primary panels is defined in part by a frangible line and a cushioning flap hingedly connected to the at least one of the primary panels and upon displacement of the cushioning flap out of the plane of the at least one of the primary panels.

Within the scope of this application it is envisaged and intended that the various aspects, embodiments, examples, features and alternatives set out in the preceding paragraphs, in the claims and/or in the following description and drawings may be taken independently or in any combination thereof. For example, features described in connection with one embodiment are applicable to all embodiments unless there is incompatibility of features.

BRIEF DESCRIPTION OF THE DRAWINGS

Exemplary embodiments of the invention will now be described with reference to the accompanying drawings, in which.

DETAILED DESCRIPTION OF EMBODIMENTS

Detailed descriptions of specific embodiments of the package, blanks and carriers are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks and carriers described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
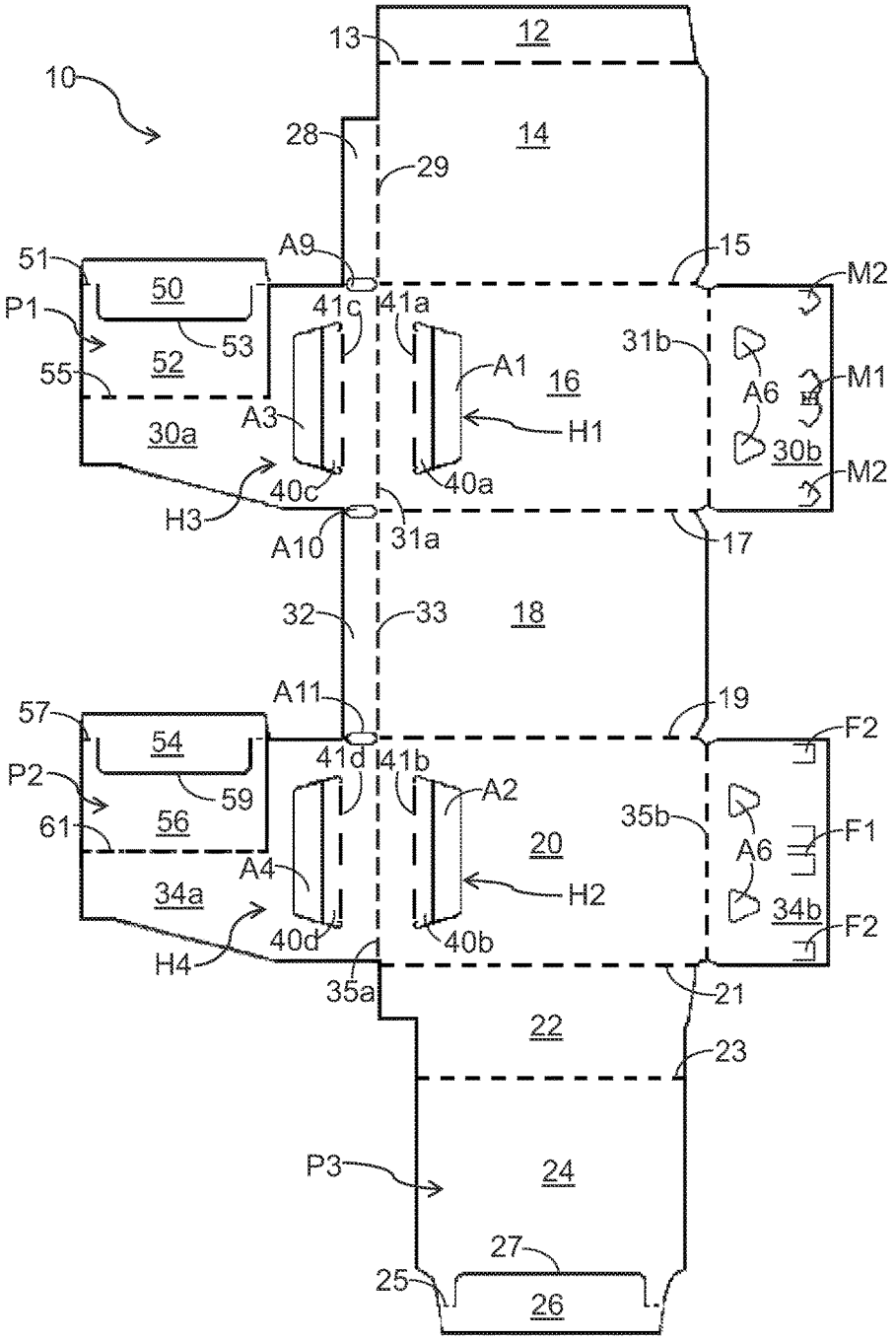
FIG. 1 is a plan view from above of a blank for forming a carrier according to a first embodiment.
Figure 2:
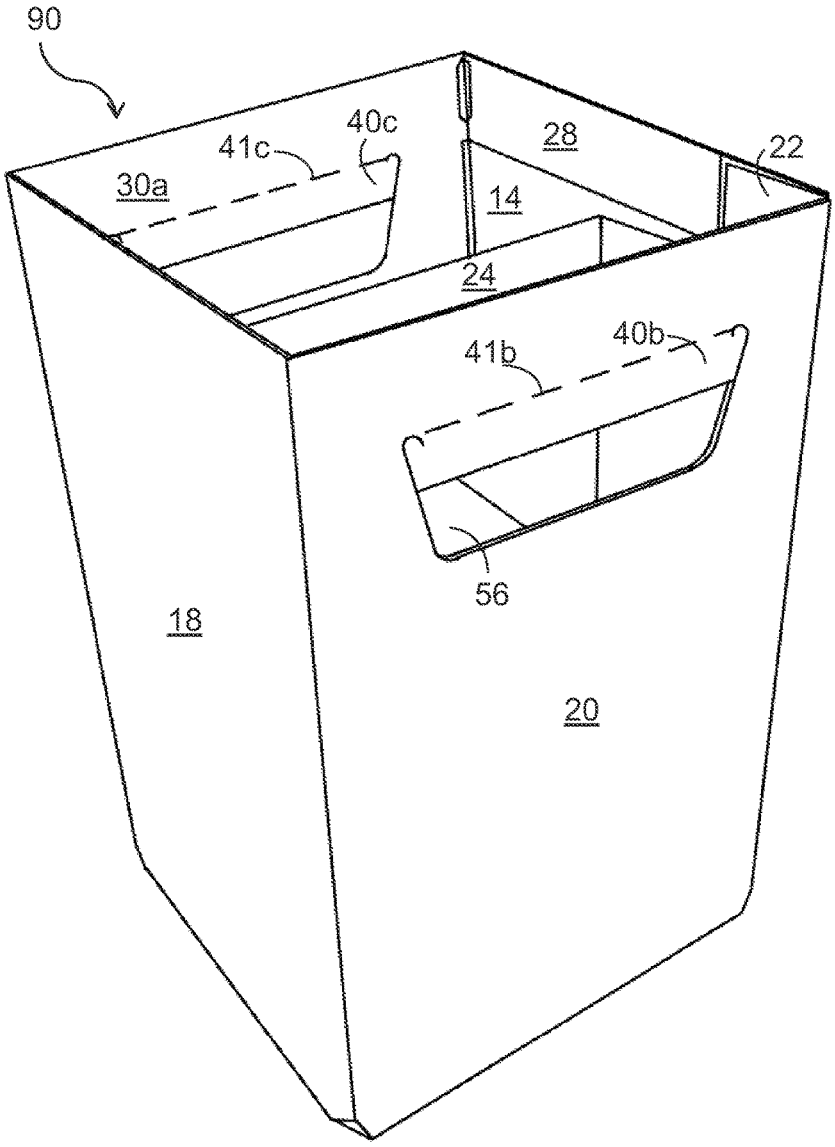
FIG. 2 is a perspective view from above of a carrier formed from the blank of FIG. 1.
Figure 3:
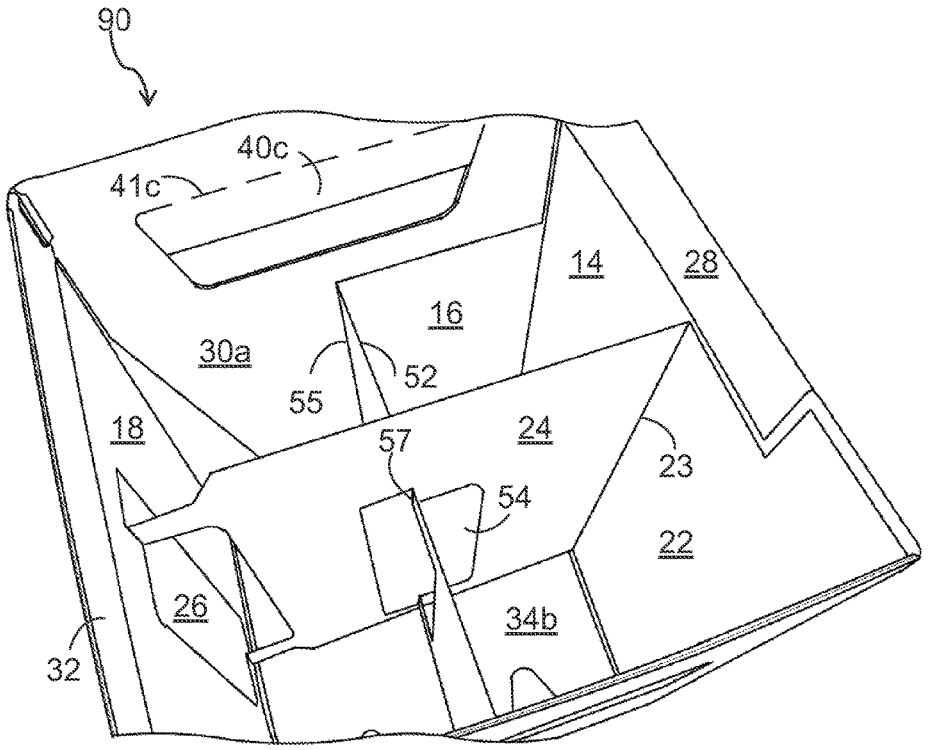
FIG. 3 is a perspective view from above of a portion of the carrier formed from the blank of FIG. 1 showing an internal cellular structure.

Referring to FIG. 1, there is shown a plan view of a blank 10 capable of forming a carrier 90 (also referred to as a carton), as shown in FIGS. 2 and 3, for holding primary products (not shown) such as, but not limited to, cans or bottles, hereinafter referred to as articles.

In the embodiments detailed herein, the terms "carton" and "carrier" refer, for the non-limiting purpose of illustrating the various features of the invention, to a container for engaging, carrying, and/or dispensing articles, such as primary product containers. It is contemplated that the teachings of the invention can be applied to various primary product containers, which may or may not be tapered and/or cylindrical. Exemplary containers include bottles (for example metallic, glass or plastics bottles), cans (for example aluminium cans), tins, pouches, packets and the like, though particular benefit is gained when the primary product containers are glass.

The blanks 10, 110, 210, 310 illustrated herein are formed from a sheet of suitable substrate. It is to be understood that, as used herein, the term "suitable substrate" includes all manner of foldable sheet material such as paperboard, corrugated board, cardboard, plastic, combinations thereof, and the like. It should be recognized that one or other numbers of blanks may be employed, where suitable, for example, to provide the carrier structure described in more detail below.

In the exemplary embodiments, the blanks 10, 110, 210, 310 are configured to form a carton or carrier for packaging an exemplary arrangement of exemplary articles. In the illustrated embodiments, the arrangement is a 2×2 matrix or array and the articles (not shown) are bottles. Alternatively, the blanks 10, 110, 210, 310 can be configured to form a carrier for packaging other types, number and size of article and/or for packaging articles in a different arrangement or configuration.

Referring to FIG. 1, the blank 10 comprises a plurality of main panels 12, 14, 16, 18, 20 hingedly connected one to the next in a linear series for forming the walls of the carrier 90 (see FIG. 2). The blank 10 comprises a first securing panel 12 hingedly connected to a first end panel 14 by a hinged connection such as a fold line 13. The first securing panel 12 is optional and may be omitted in alternative embodiments. The first end panel 14 is hingedly connected to a first side panel 16 by a hinged connection such as a fold line 15. The first side panel 16 is hingedly connected to a second end panel 18 by a hinged connection such as a fold line 17. The second end panel 18 is hingedly connected to a second side panel 20 by a hinged connection such as a fold line 19.

The blank 10 comprises a first partition structure P1 (discussed below), a second partition structure P2 (discussed below) and a third partition structure P3.

The second side panel 20 is coupled to the third partition structure P3. The third partition structure P3 comprises a second securing panel 22 hingedly connected to the second side panel 20 by a hinged connection such as a fold line 21. The third partition structure P3 comprises a third partition panel 24 hingedly connected to the second securing panel 22 along hinged connection such as a fold line 23. The third partition structure P3 comprises a third securing panel 26 hingedly connected to the third partition panel 24 along a hinged connection such as a fold line 25. The fold line 25 is optionally interrupted by a severance or cut line 27. The cut line 27 is substantially an inverted "U" shape; and is arranged such that a portion of the third securing panel 26 is effectively struck from the third partition panel 24, that is to say said portion of the third securing panel 26 is formed from material which would otherwise form part of the third partition panel 24 if cut line 27 were omitted.

The second securing panel 22, the third partition panel 24 and the third securing panel 26 are hingedly connected one to the next in a linear series with the plurality of main panels 12, 14, 16, 18, 20.

The blank 10 comprises a first base panel **30*b* hinged to the first side panel 16 by a hinged connection such as a fold line 31*b*. The blank 10 comprises a second base panel 34*b* hingedly connected to the second side panel 20 by a hinged connection such as a fold line 35*b*. The first base panel 30*b* and the second base panel 34*b* are configured to at least partially overlap so as to be securable together to form a composite base wall 30*b*/34*b* in a set up carrier 90. In the embodiment illustrated in FIG. 1 the first and second base panels 30*b*, 34*b* optionally comprise a complementary locking mechanism for securing the first base panel 30*b* to the second base panel 34*b*. The complementary locking mechanism comprises a first male punch tab M1 and a pair of second male punch tabs M2 struck from the first base panel 30***b* and hingedly connected thereto. The complementary locking mechanism also comprises a first female tab F1 and a pair of second female tabs F2 struck from the second base panel 34*b* and hingedly connected thereto. The first and second female tabs F1, F2 define apertures in the second base panel 34*b*.

The first and second male punch tabs M1, M2 are displaced out of the plane of the first base panel 30*b*, inwardly of the carton 90, so as to push the respective first and second female tabs F1, F2 inwardly of the carton 90. The first and second male punch tabs M1, M2 have a substantially arrow head shape, including shoulders which have a greater width dimension than the width of the respective apertures formed in the second base panel 34*b* by displacement of the first and second female tabs F1, F2. The shoulders of the first and second male punch tabs M1, M2 bend or deform when passing through the respective apertures in the second base panel 34*b* and return to a substantially planar condition with the rest of the respective one of the first and second male punch tabs M1, M2. In this way the first base panel 30*b* can be locked to the second base panel 34*b*.

The first base panel 30*b* and the second base panel 34*b* each comprise a pair of apertures A6. The apertures A6 facilitate assembly of the composite base panel 30*b*/34*b*; a tool or tools may engage with the apertures A6 so as to align and tighten the first base panel 30*b* and the second base panel 34*b* together.

The blank 10 additionally comprises a first end wall reinforcing panel 28 hingedly connected along an upper edge of the first end wall 14 by a hinged connection such as a fold line 29.

The blank 10 comprises a second end wall reinforcing panel 32 hingedly connected along an upper edge of the second end wall 18 by a hinged connection such as a fold line 33.

The first side panel 16 comprises a first handle structure H1. The first handle structure H1 comprises a first handle aperture A1 struck therefrom. The first handle aperture A1 is defined in part by an optional cushioning flap 40*a* which is hingedly connected to the first side panel 16 by a hinged connection such as a fold line 41*a*.

The second side panel 20 comprises a second handle structure H2. The second handle structure H2 comprises a second handle aperture A2 struck therefrom. The second handle aperture A2 is defined in part by an optional cushioning flap 40*b* which is hingedly connected to the second side panel 20 by a hinged connection such as a fold line 41*b*.

The blank 10 comprises a first handle reinforcing panel 30*a* and a second handle reinforcing panel 34*a*. The first handle reinforcing panel 30*a* is hingedly connected to the first side panel 16 by a hinged connection such as a fold line 31*a*. The second handle reinforcing panel 34*a* is hingedly connected to the second side panel 20 by a hinged connection such as a fold line 35*a*.

The first handle reinforcing panel 30*a* comprises a third handle structure H3. The third handle structure H3 comprises a third handle aperture A3 struck therefrom. The third handle aperture A3 is defined in part by an optional cushioning flap 40*c* which is hingedly connected to the first handle reinforcing panel 30*a* by a hinged connection such as a fold line 41*c*.

The second handle reinforcing panel 34*a* comprises a fourth handle structure H4. The fourth handle structure H4 comprises a fourth handle aperture A4 struck therefrom. The fourth handle aperture A4 is defined in part by an optional cushioning flap 40*d* which is hingedly connected to the second handle reinforcing panel 34*a* by a hinged connection such as a fold line 41*d*.

The first partition structure P1 comprises a first partition panel 52 hingedly connected to the first handle reinforcing panel 30*a* by a hinged connection such as a fold line 55. The first partition panel 52 is struck from the first handle reinforcing panel 30*a*. The first partition structure P1 comprises a fourth securing panel 50; the fourth securing panel 50 is hingedly connected to the first partition panel 52 by a hinged connection such as a fold line 51. The fold line 51 is interrupted by a "U" shaped severance or cut line 53, such that a portion of the fourth securing panel 50 is effectively struck from the first partition panel 52.

The second partition structure P2 comprises a second partition panel 56 hingedly connected to the second handle reinforcing panel 34*a* by a hinged connection such as a fold line 61. The second partition panel 56 is struck from the second handle reinforcing panel 34*a*. The second partition structure P2 comprises a fifth securing panel 54; the fifth securing panel 54 is hingedly connected to the second partition panel 56 by a hinged connection such as a fold line 57. The fold line 57 is interrupted by a "U" shaped severance or cut line 59, such that a portion of the fifth securing panel 54 is effectively struck from the second partition panel 56.

The first end wall reinforcing panel 28 is hingedly connected to the first handle reinforcing panel 30*a* by the fold line 15; fold line 15 is interrupted by an aperture A9 which aperture A9 is struck in part from the first end wall reinforcing panel 28 and in part from the first handle reinforcing panel 30*a*. Aperture A9 reduces the amount of material present at an internal corner when the carrier 90 is constructed.

The first handle reinforcing panel 30*a* is hingedly connected to the second end wall reinforcing panel 32 by the fold line 17; fold line 17 is interrupted by an aperture A10 which aperture A10 is struck in part from second end wall reinforcing panel 32 and in part from the first handle reinforcing panel 30*a*. Again, aperture A10 is provided to reduce the amount of material present to avoid bunching or creasing of material at an internal corner.

The second end wall reinforcing panel 32 is hingedly connected to the second handle reinforcing panel 34*a* by the fold line 19; fold line 19 is interrupted by an aperture A11 which aperture A11 is struck in part from second end wall reinforcing panel 32 and in part from the second handle reinforcing panel 34*a*. Aperture A11 also mitigates bunching of material.

Turning to the construction of the blank 10 into a carrier 90, as illustrated in FIGS. 4 to 8, the carrier 90 (see FIGS. 2 and 3) can be formed by a series of sequential folding operations in a straight line machine so that the carrier 90 is not required to be rotated or inverted to complete its construction. The folding process is not limited to that described below and may be altered according to particular manufacturing requirements.

Figure 4:
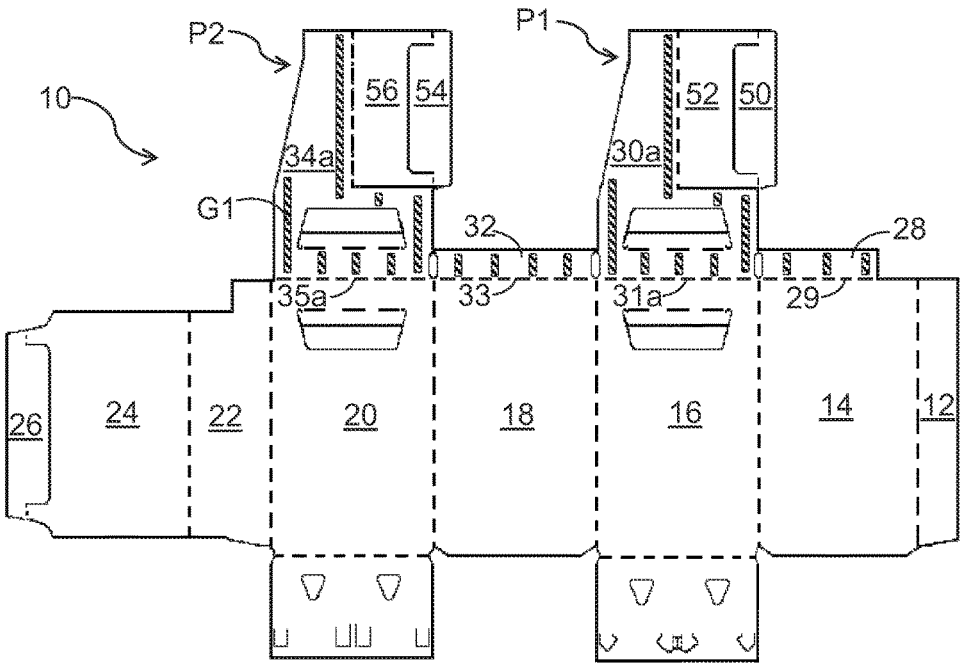
FIGS. 4 to 8 are plan views from above of stages of construction of the blank of FIG. 1.

Referring to FIG. 4, glue G1 or other adhesive treatment is applied to the first end wall reinforcing panel 28, the first handle reinforcing panel 30*a*, the second end wall reinforcing panel 32 and the second handle reinforcing panel 34*a*.

Figure 5:
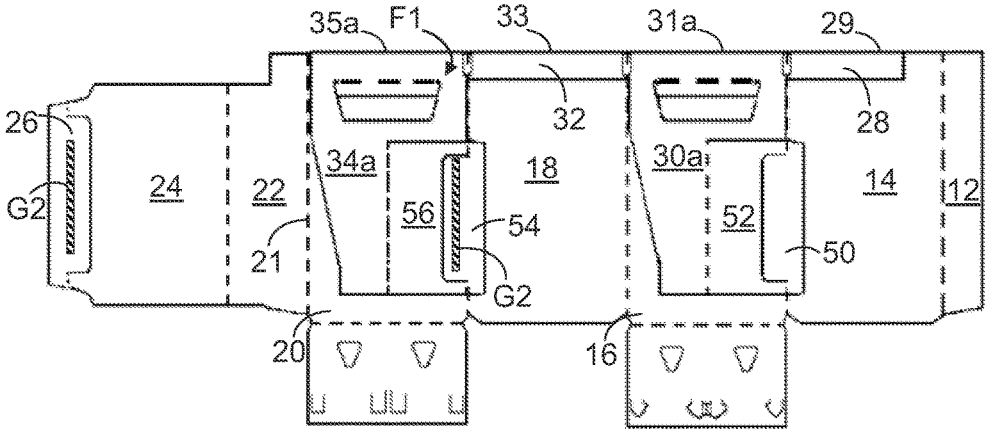

The blank 10 is folded, as shown in FIG. 5 by direction arrow F1, about fold lines 29, 31*a*, 33 and 35*a* such that the first end wall reinforcing panel 28, the first handle reinforcing panel 30*a*, together with the first partition structure P1, the second end wall reinforcing panel 32 and the second handle reinforcing panel 34*a* together with the second partition structure P2 are folded thereabout respectively. The first end wall reinforcing panel 28 is secured to the first end panel 14. The first handle reinforcing panel 30*a* is secured to the first side panel 16 and the first partition structure P1 is brought into overlaying contact therewith. The second end wall reinforcing panel 32 is secured to the second end panel 18. The second handle reinforcing panel 34*a* is secured to the second side panel 20 and the second partition structure P2 is brought into overlaying contact therewith.

Glue G2 or other adhesive treatment is applied to the third securing panel 26 and to the fifth securing panel 54 as shown in FIG. 5.

Figure 6:
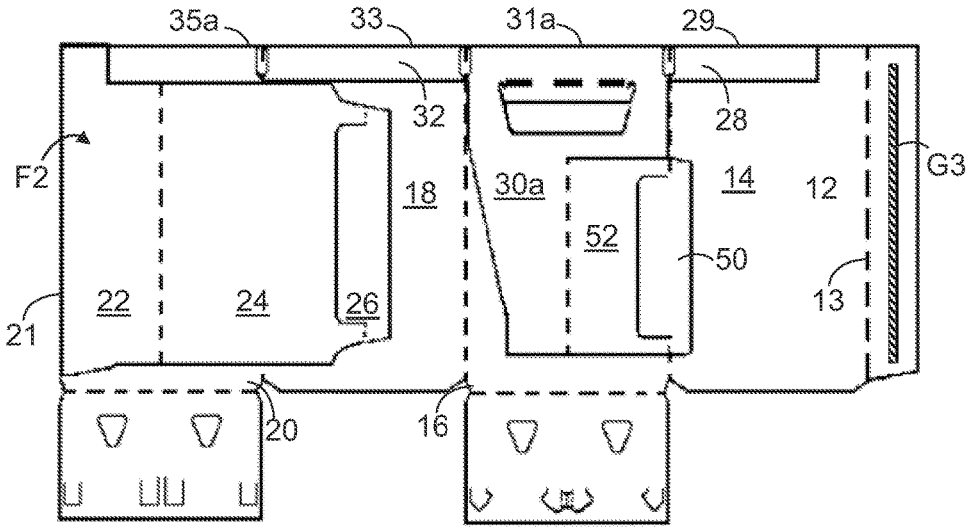

The blank 10 is folded, as indicated by direction arrow F2 in FIG. 6, about fold line 21 such that the third partition structure P3 (including the second securing panel 22, third partition panel 24 and third securing panel 26 thereof) is brought into face contacting relationship with regions of the outside surfaces of: the second handle reinforcing panel 34*a*; the second partition panel 56; and the fifth securing panel 54 of the second partition structure P2. Additionally, part of the third partition structure P3 is brought into face contacting relationship with part of an inside surface of the second end panel 18 and the second side panel 20. In this way, the third securing panel 26 of the third partition structure P3 is secured, affixed or otherwise attached to the fifth securing panel 54 and the third securing panel 26 is affixed to the second end panel 18.

Glue G3 or other adhesive treatment is applied to an inside surface of the first securing panel 12 as shown in FIG. 6.

Figure 7:
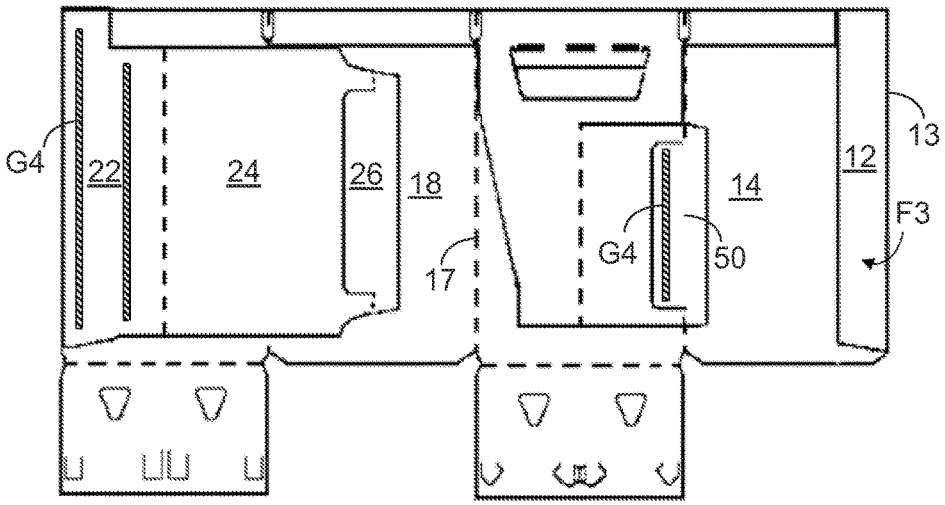

The blank 10 is folded, as indicated by direction arrow F3 in FIG. 7, about fold line 13 such that the first securing panel 12 is brought into face contacting relationship with and is affixed to the first end panel 14.

Optionally, the first securing panel 12 is co-extensive with the first end panel 14 and the first end wall reinforcing panel 28 stops short of fold line 13 such that once the first securing panel 12 is folded and secured to the first end panel 14 as described, the first securing panel 12 and the first end wall reinforcing panel 28 do not overlap. In other arrangements, overlap of the first end wall reinforcing panel 28 and the first securing panel 12 may be avoided by other methods, for example by making the first securing panel 12 not co-extensive with the first end panel 14 and/or allowing the first end wall reinforcing panel 28 to extend substantially the full width of the first end panel 14.

Glue G4 or other adhesive treatment is applied to an outside surface of the second securing panel 22 and to the fourth securing panel 50 as shown in FIG. 7.

Figure 8:
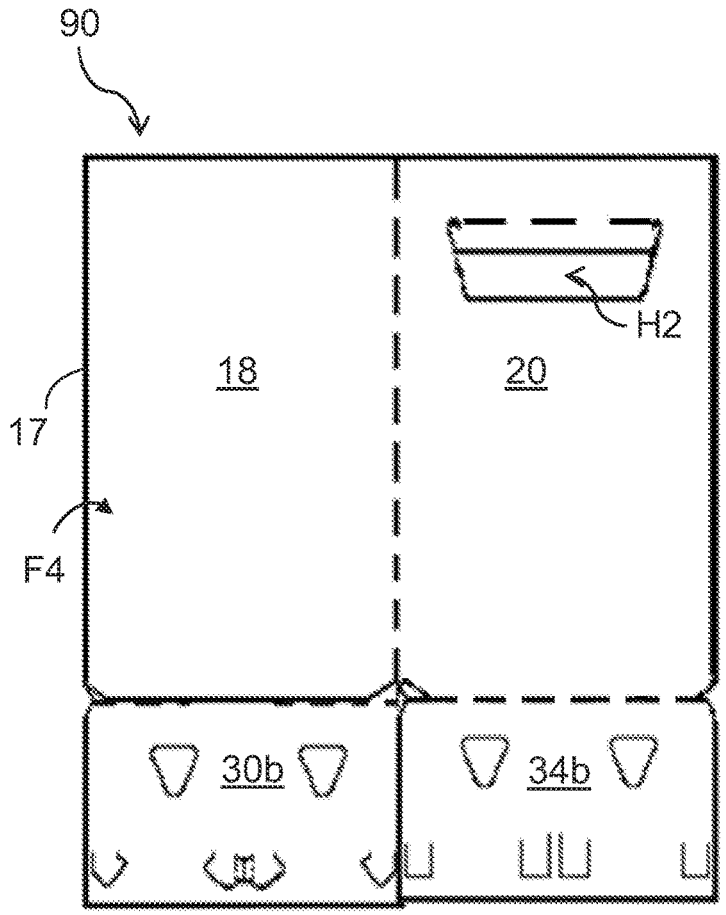

The blank 10 is folded, as indicated by direction arrow F4 in FIG. 8, about fold line 17 such that the third partition structure P3, together with the second end panel 18, second side panel 20 and second base panel 34*b* are brought on top of the first handle reinforcing panel 30*a*, first partition structure P1, first end panel 14 and first securing panel 12. In this way, the fourth securing panel 50 is affixed to the third partition panel 24 and the second securing panel 22 is affixed to the first securing panel 12 and to the first end panel 14.

A flat collapsed carrier is formed as shown in FIG. 8. The flat collapsed carrier may be shipped or distributed in this flat collapsed form.

The flat collapsed carrier may be erected into a tubular structure, for example, by separating the first side panel 16 from the second side panel 20. In this way an open ended carrier 90 is formed and the first and second base panels 30*b*, 34*b* can be affixed together as described above to form a composite base wall 30*b*/34*b*. The completed carrier 90 is illustrated in FIGS. 2 and 3. The carrier 90 has a plurality of cells each for receiving an article (not shown). The illustrated carrier 90 has four cells.

The partition structures P1, P2, P3 are automatically erected within the carrier 90 when the flat collapsed carrier is erected.

The carrier 90, in its erected form, may be loaded with articles through an open top end of the carrier 90.

The partition structures P1, P2, P3 divide the interior space of the carrier 90 into cells; in the illustrated embodiment there are four cells arranged in a 2×2 array. As can be seen in FIG. 3, the third partition panel 24 extends between the first end panel 14 and the second end panel 18. The first partition panel 52 extends between the first side panel 16 and the third partition panel 24. The second partition panel 56 extends between the second side panel 20 and the third partition panel 24.

The third partition panel 24 divides the interior space of the carrier 90 in a first direction and the first and second partition panels 52, 56 divide the interior space of the carrier 90 in a second, transverse, direction.

The second and third securing panels 22, 26 support the third partition panel 24. The second securing panel 22 spaces the third partition panel 24 apart from the second side wall 20; the width dimension (the distance between fold line 23 and fold line 21) of the second securing panel 22 determines the location of the third partition panel 24 within the carrier 90. In the illustrated embodiment the second securing panel 22 is configured such that the third partition panel 24 substantially bisects the interior space of the carrier 90 in the first direction.

The fourth securing panel 50 (not visible in FIG. 3) and the first handle reinforcing panel 30*a* support the first partition panel 52. The first handle reinforcing panel 30*a* spaces the first partition panel 52 apart from the second end wall 18. The location of fold line 55 determines, to some extent at least, the location of the first partition panel 52 within the carrier 90. In the illustrated embodiment the first partition panel 52 substantially bisects or divides the interior space of the carrier 90 in the second direction.

The fifth securing panel 54 and the second handle reinforcing panel 34*a* (not visible in FIG. 3) support the second partition panel 56. The second handle reinforcing panel 34*a* spaces the second partition panel 56 apart from the first end wall 14. The location of fold line 61 determines the location of the second partition panel 56 within the carrier 90. In the illustrated embodiment the second partition panel 56 substantially bisects or divides the interior space of the carrier 90, also in the second direction. Preferably, the first and second partition panels 52, 56 are disposed in alignment with, and in the same plane as, one another.

Referring now to FIGS. 9 to 16, there is shown an additional embodiment of the present disclosure. In the second illustrated embodiment, like numerals have, where possible, been used to denote like parts, albeit with the addition of the prefix "100" to indicate that these features belong to the second embodiment. The additional embodiment shares common features with the first embodiment and therefore only the differences from the embodiment illustrated in FIGS. 1 to 8 will be described in detail.

Figure 10:
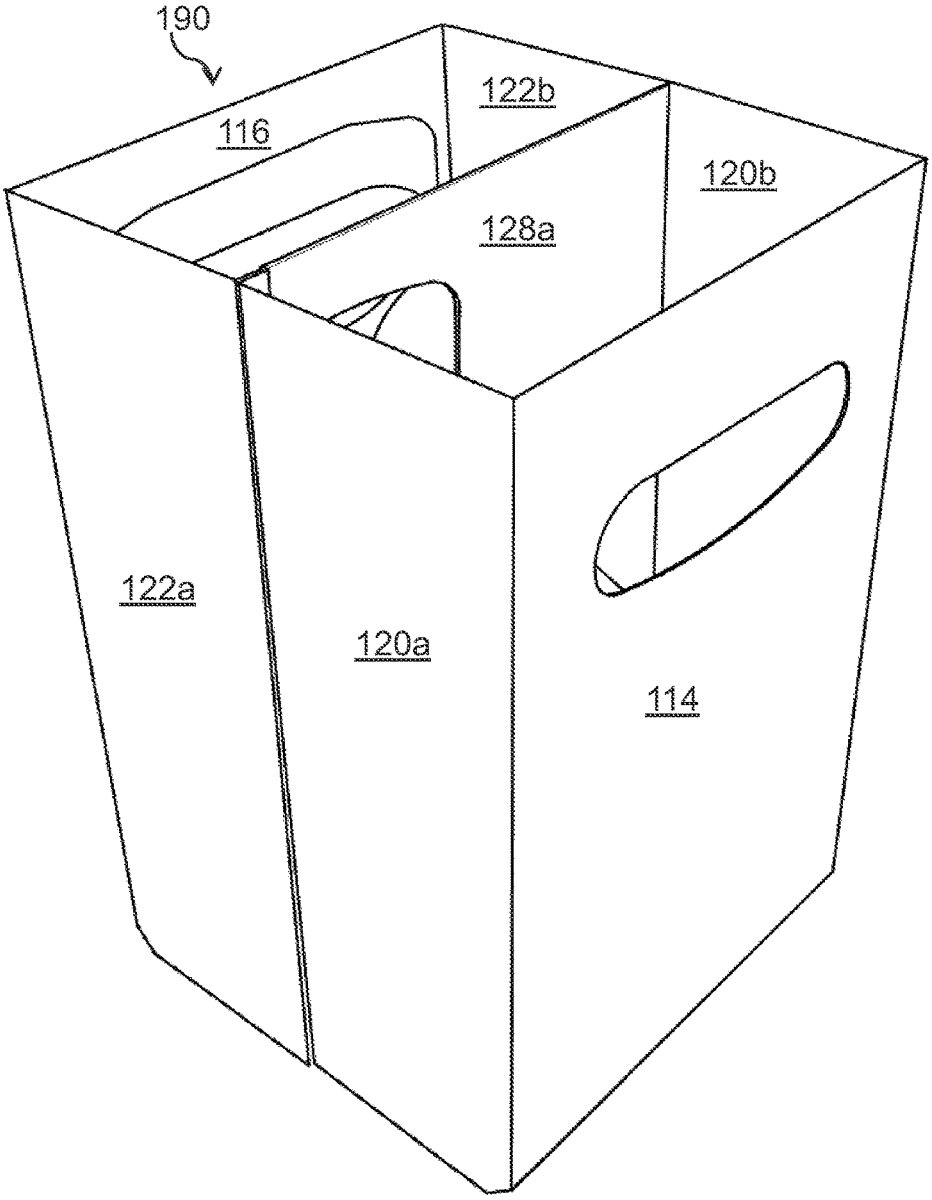
FIG. 10 is a perspective view from above of a carrier formed from the blank of FIG. 9.
Figure 11:
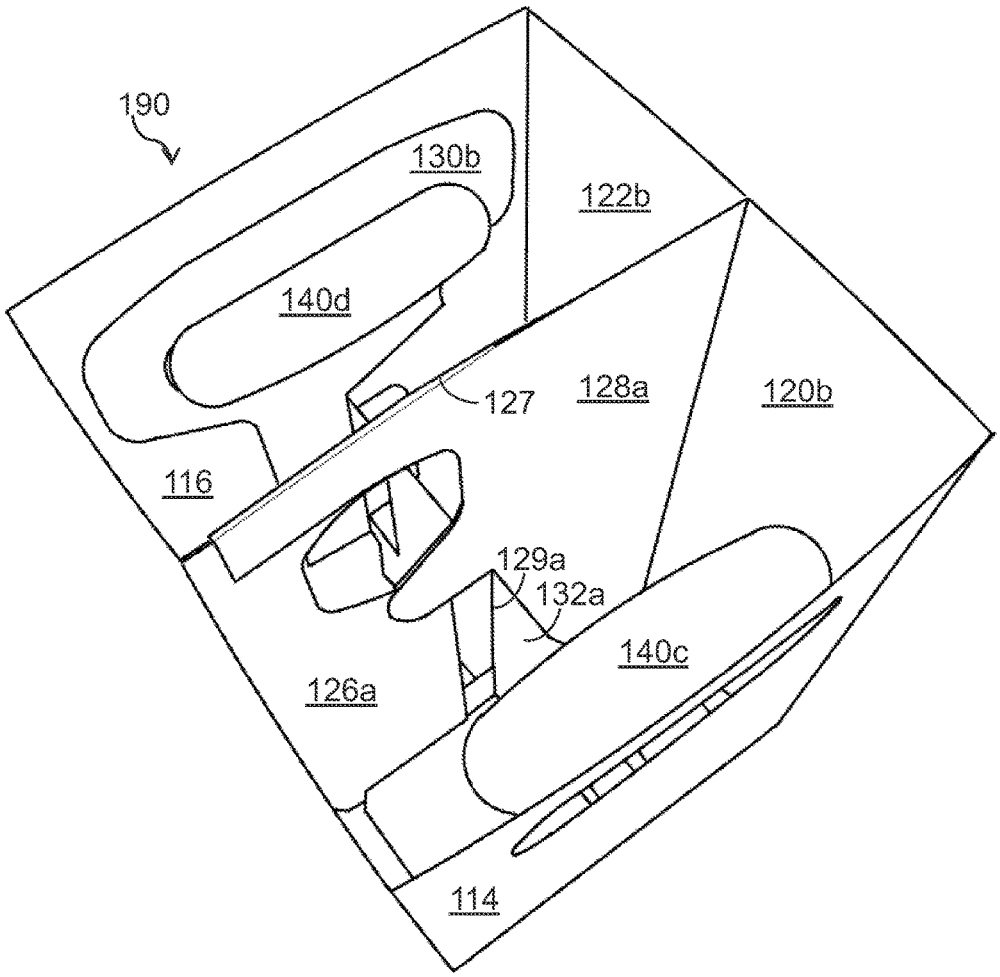
FIG. 11 is a perspective view from above of a portion of the carrier formed from the blank of FIG. 9 showing an internal cellular structure.
Figure 12:
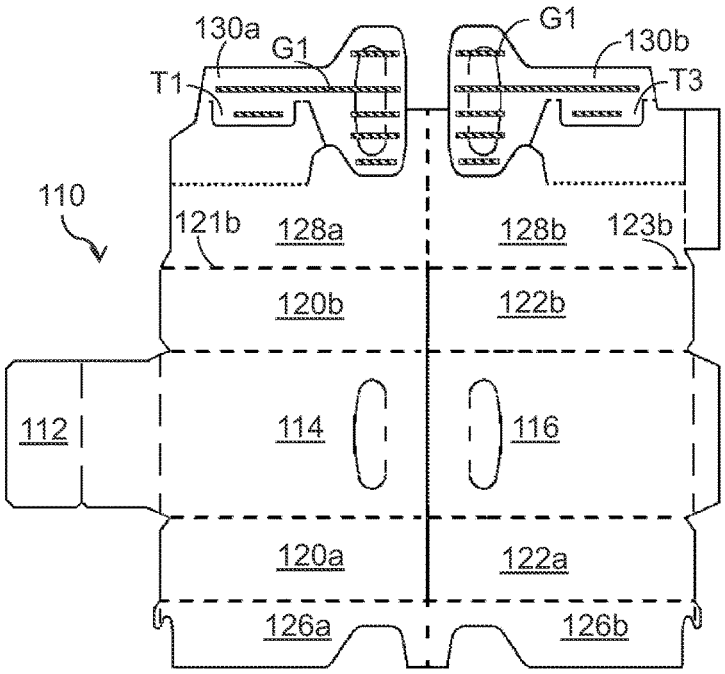
FIGS. 12 to 16 are plan views from above of stages of construction of the blank of FIG. 9.

The blank 110 comprises a first linear series of panels 126*a*, 120*a*, 114, 120*b*, and 128*a*, and a second linear series of panels 126*b*, 122*a*, 116, 122*b* and 128*b*, disposed in mirror image to the first linear series of panels, for forming the walls and internal partitions of a carrier 190 illustrated in FIGS. 10 and 11.

The first linear series of panels of the blank 110 comprises a first end panel 120*a* hingedly connected by a hinged connection such as a fold line 115*a* to a first side panel 114. The first side panel 114 is hingedly connected to a third end panel 120*b* by a hinged connection such as a fold line 115*b*. Optionally, a base panel 112 is hingedly connected by a hinged connection such as a fold line 113 to a bottom edge of the first side panel 114.

The second linear series of panels of the blank 110 comprises a second end panel 122*a* hingedly connected by a hinged connection such as a fold line 117*a* to a second side panel 116. The second side panel 116 is hingedly connected to a fourth end panel 122*b* by a hinged connection such as a fold line 117*b*. Optionally, a first securing panel 118 is hingedly connected by a hinged connection such as a fold line 119 to the bottom edge of the second side panel 116.

Optionally, a base panel 112 is hingedly connected by a hinged connection such as a fold line 113 to a bottom edge of the first side panel 114. Optionally a first securing panel 118 is hingedly connected by a hinged connection such as a fold line 119 to the bottom edge of the second side panel 116.

The blank 110 comprises a first partition structure (discussed below), a second partition structure (discussed below) and a third partition structure.

The third partition structure comprises a first riser panel 126*a* hingedly connected by a hinged connection such as a fold line 121*a* to the first end panel 120*a*; and a third partition panel 128*a*. The third partition panel 128*a* is hingedly connected by a hinged connection such as a fold line 121*b* to the third end panel 120*b*. The third partition structure additionally comprises a second riser panel 126*b* hingedly connected by a hinged connection such as a fold line 123*a* to the second end panel 122*a*; and a fourth partition panel 128*b*. The fourth partition panel 128*b* is hingedly connected by a hinged connection such as a fold line 123*b* to the fourth end panel 122*b*. The first and second riser panels 126*a*, 126*b* are hingedly connected to one another along an upper edge thereof by a hinged connection such as a fold line 125. The third and fourth partition panels 128*a*, 128*b* are also adjoined by a hinged connection defined by a hinged connection such as a fold line 127 along their common upper edge.

The blank 110 comprises a first handle reinforcing panel 130*a* and a second handle reinforcing panel 130*b*. The first handle reinforcing panel 130*a* is hingedly connected to the first partition structure which itself is hingedly connected to the third partition panel 128*a* by a hinged connection such as a fold line 129*a*. The second handle reinforcing panel 130*b* is hingedly connected to the second partition structure, which itself is hingedly connected to the fourth partition panel 128*b* by a hinged connection such as a fold line 129*b*.

The first partition structure comprises a first partition panel 132*a* hingedly connected to the first handle reinforcing panel 130*a* by a hinged connection such as a fold line 133*a*. The first partition panel 132*a* may be considered as being struck from the first handle reinforcing panel 130*a*. The first partition structure comprises a second securing panel T1 hingedly connected to the first partition panel 132*a* by the fold line 133*a* which is interrupted by a generally "U" shaped severance or cut line 135*a*, such that a portion of the second securing panel T1 is struck from the first partition panel 132*a*.

The second partition structure comprises a second partition panel 132*b* hingedly connected to the second handle reinforcing panel 130*b* by a hinged connection such as a fold line 133*b*. The second partition panel 132*b* may be considered as being struck from the second handle reinforcing panel 130*b*. The second partition structure comprises a third securing panel T3 hingedly connected to the second partition panel 132*b* by the fold line 133*b* which is interrupted by a generally "U" shaped severance or cut line 135*b*, such that a portion of the third securing panel T3 is struck from the second partition panel 132*b*.

The first side panel 114 comprises a first handle structure that comprises a first handle aperture defined in part by an optional cushioning flap 140*a* which is hingedly connected to the first side panel 114 by a hinged connection such as a fold line 141*a*.

The second side panel 116 comprises a second handle structure that comprises a second handle aperture defined in part by an optional cushioning flap 140*b* which is hingedly connected to the second side panel 116 by a hinged connection such as a fold line 141*b*.

The first handle reinforcing panel 130*a* comprises a third handle structure that comprises a third handle aperture defined in part by an optional cushioning flap 140*c* which is hingedly connected to the first handle reinforcing panel 130*a* by a hinged connection such as a fold line 141*c*.

The second handle reinforcing panel 130*b* comprises a fourth handle structure that comprises a fourth handle aperture defined in part by an optional cushioning flap 140*d* which is hingedly connected to the second handle reinforcing panel 130*b* by a hinged connection such as a fold line 141*d*.

Figure 9:
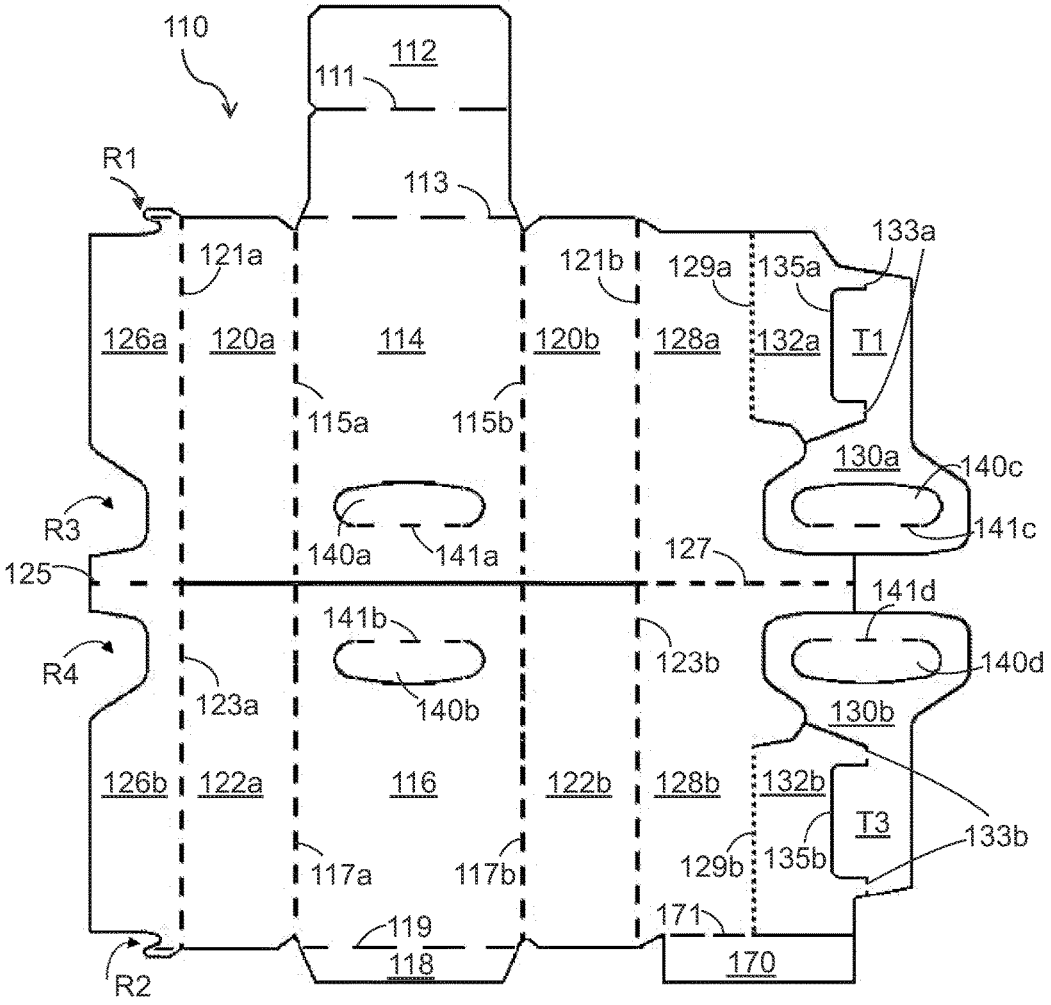
FIG. 9 is a plan view from above of a blank for forming a carrier according to a second embodiment.

A fourth securing panel 170 is hingedly connected to a lower edge of the fourth partition panel 128*b* by a hinged connection such as a fold line 171 and although co-extensive with the second partition panel 132*b* is optionally separated therefrom by a cut line (see FIG. 9).

The first riser panel 126*a* optionally comprises a first recess R1 which helps to define a catch at the bottom edge of the first riser panel 126*a* which is provided for assisting in mechanically maintaining the foldable base wall 112 in a set-up condition.

The second riser panel 126*b* optionally comprises a second recess R2 which helps to define a catch at the bottom edge of the second riser panel 126*b* which is provided for assisting in mechanically maintaining the foldable base wall in a set-up condition.

The first riser panel 126*a* optionally comprises a third recess R3 for facilitating nesting of two or more blanks 110 in a sheet of material. The third recess R3 is sized and configured to fit about part of the first handle reinforcing panel 130*a* of an adjacent similarly arranged blank (not shown).

The second riser panel 126*b* optionally comprises a fourth recess R4 for facilitating nesting of two or more blanks 110 in a sheet of material. The fourth recess R4 is sized and configured to fit about part of the second handle reinforcing panel 130*b* of an adjacent similarly arranged blank (not shown).

Turning to the construction of the blank 110 into a carrier 190, as illustrated in FIGS. 12 to 16, the carrier 190 (see FIGS. 10 and 11) can be formed by a series of sequential folding operations in a straight line machine so that the carrier 190 is not required to be rotated or inverted to complete its construction. The folding process is not limited to that described below and may be altered according to particular manufacturing requirements.

Glue G1 or other adhesive treatment is applied to the first and second handle reinforcing panels 130*a*, 130*b* and to the second and third securing panels T1, T3 of the first and second partition structures.

Figure 13:
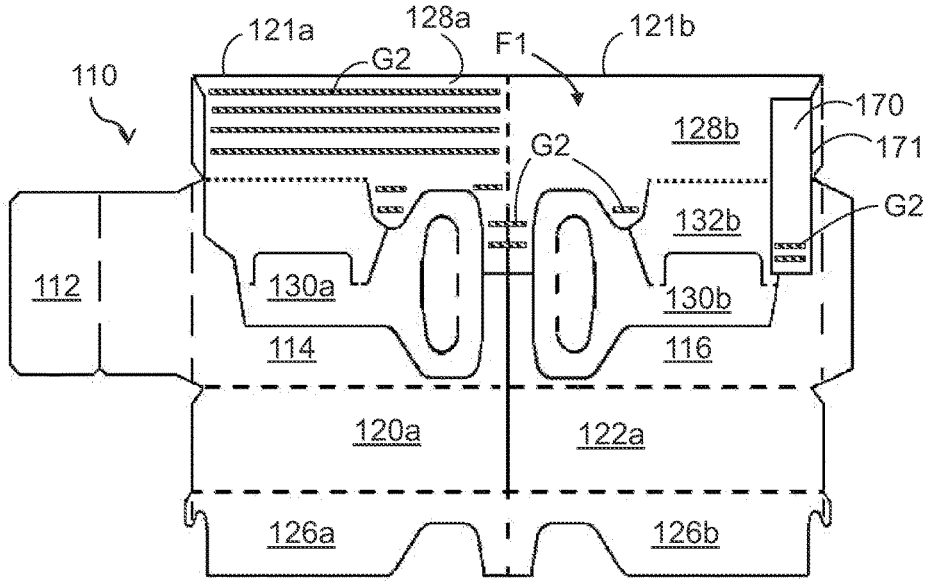

The blank 110 is folded, as indicated by direction arrow F1 in FIG. 13, about fold lines 121*b*, 123*b* such that the third and fourth partition panels 128*a*, 128*b* overlay portions of the third and fourth end panels 120*b*, 122*b*; and such that the first and second handle reinforcing panels 130*a*, 130*b*, along with the second and third securing panels T1, T3 are brought into face contacting relationship with first and second side panels 114, 116 respectively. In this way the first and second handle reinforcing panels 130*a*, 130*b* are affixed to the first and second side panels 114, 116 to reinforce the first and second handle structures respectively.

The fourth securing panel 170 is folded about the fold line 171 and brought into face contacting relationship with a portion of the second partition panel 132*b* and a part of the fourth partition panel 128*b*.

Glue G2 or other adhesive treatment is applied to the fourth securing panel 170, to the third partition panel 128*a*; and to very small regions of the fourth partition panel 128*b*.

Figure 14:
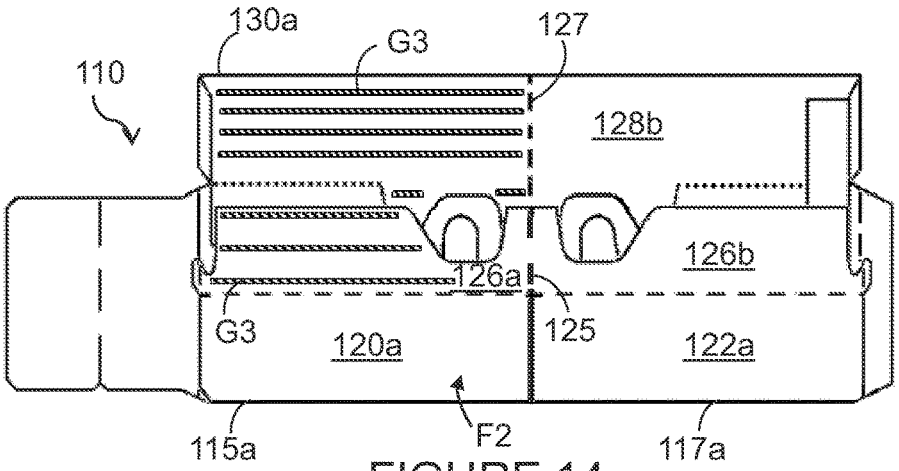

The blank 110 is folded, as indicated by direction arrow F2 in FIG. 14, about the fold lines 115*a* and 117*a*, to bring the first end panel 120*a*, together with the first riser panel 126*a*, into face contacting relationship with the first side panel 114; and to bring the second end panel 122*a* and second riser panel 126*b* into face contacting relationship with the second side panel 116.

Glue G3 or other adhesive treatment is applied to the first riser panel 126*a*.

Figure 15:
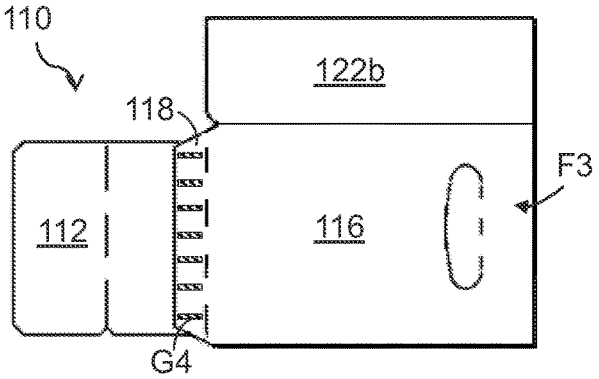

Then, the blank 110 is folded, as indicated by direction arrow F3 in FIG. 15, about the medial fold lines 125 and 127, to bring the third end panel 120*b* into face contacting relationship with fourth end panel 122*b*; and to bring the second riser panel 126*b* into face-contacting and affixed relationship with the first riser panel 126*a*. The fourth partition panel 128*b* is then disposed over and affixed to the third partition panel 128*a*. The fourth securing panel 170 is partially sandwiched between the third and fourth partition panels 128*a*, 128*b*.

Glue G4 or other adhesive treatment is applied to the first securing panel 118.

Figure 16:
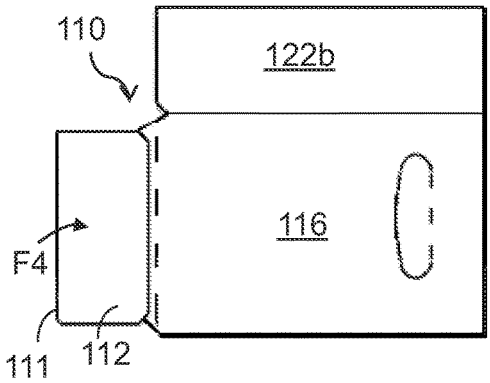

The base panel 112 is then folded, as indicated by direction arrow F4 in FIG. 16 about the fold line 111 to affix the base panel 112 to the first securing panel 118.

A flat collapsed carrier is formed as shown in FIG. 16. The flat collapsed carrier may be shipped or distributed in this flat collapsed form.

The flat collapsed carrier may be erected into a tubular structure by separating the first side panel 114 from the second side panel 116. In this way an open topped carrier 190 is formed and the first base panel 112 is automatically positioned. The catches of the first and second riser panels 126*a*, 126*b* assist in maintaining the first base panel 112 in a flat erect form. The completed carrier 190 is illustrated in FIGS. 10 and 11. The carrier 190 has a plurality of cells each for receiving an article (not shown). The illustrated carrier 190 has four cells.

The partition structures are automatically erected within the carrier 190 when the flat collapsed carrier is erected.

The carrier 190, in its erected form, may be loaded with articles through open top end of the carrier 190.

The first, second and third partition structures divide the interior space of the carrier 190 into cells; in the illustrated embodiment there are four cells arranged in a 2×2 array. The third partition panel 128*a*, the fourth partition panel 128*b*, the first riser panel 126*a*, and the second riser panel 126*b* together form a central partition which extends between a first end wall 120*a*/122*a* formed from the first and second end panels 120*a*, 122*a* and a second end wall 120*b*/122*b* formed from the third and fourth end panels 120*b*, 122*b*. The first partition panel 132*a* extends between the first side panel 114 and the central partition. The second partition panel 132*b* extends between the second side panel 116 and the central partition.

The first partition panel 132*a* is supported at one end by the first handle reinforcing panel 130*a* and at the other end by the third partition panel 128*a*. The second partition panel 132*b* is supported at one end by the second handle reinforcing panel 130*b* and at the other end by the fourth partition panel 128*b*.

Referring now to FIGS. 17 to 23, there is shown an additional embodiment of the present disclosure. In the third illustrated embodiment, like numerals have, where possible, been used to denote like parts, albeit with the addition of the prefix "200" to indicate that these features belong to the third embodiment. The additional embodiment shares many common features with the first and second embodiments and therefore only the differences from the embodiments illustrated in FIGS. 1 to 16 will be described in detail.

Figure 17:
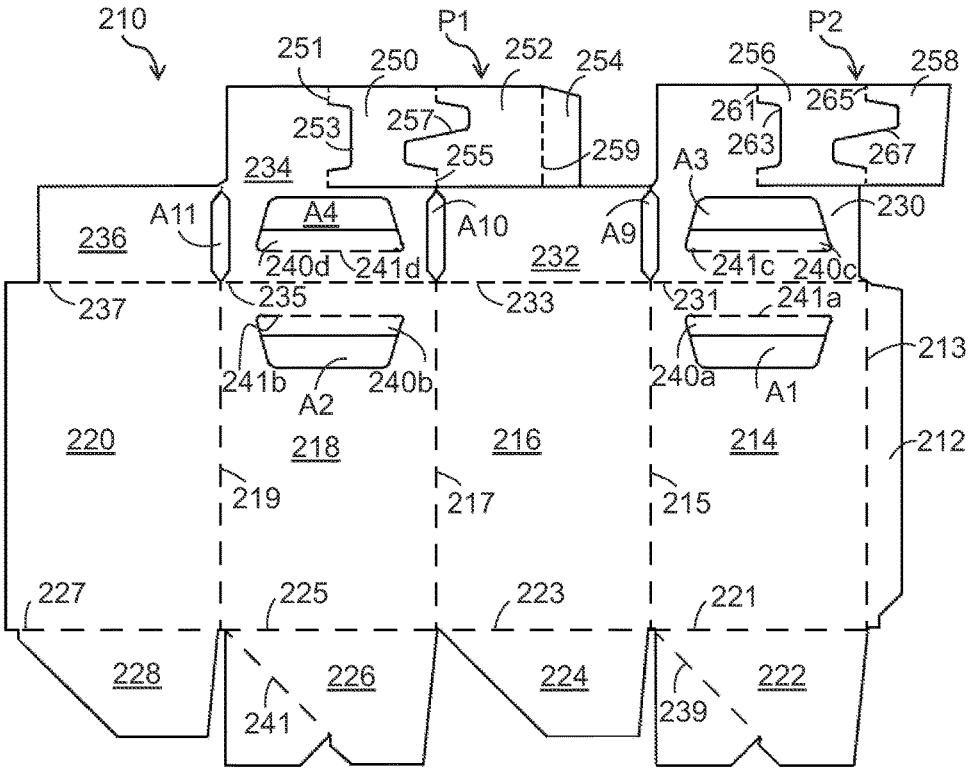
FIG. 17 is a plan view from above of a blank for forming a carrier according to a third embodiment.
Figure 18:
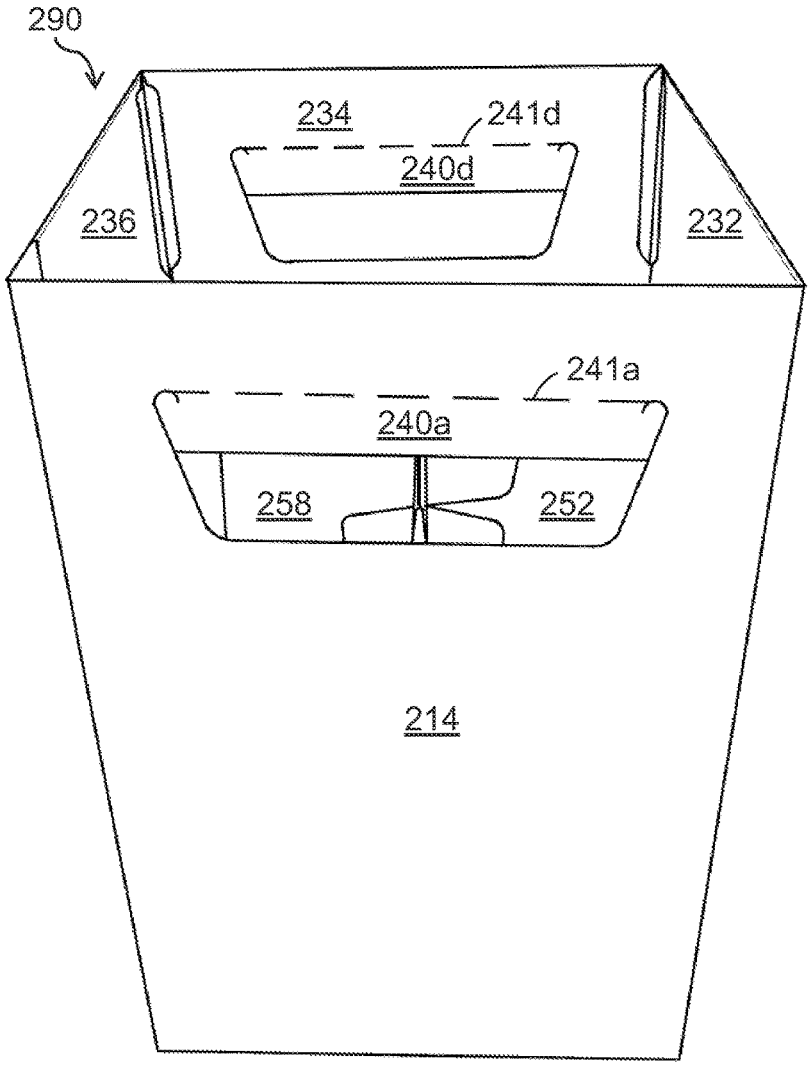
FIG. 18 is a perspective view from above of a carrier formed from the blank of FIG. 17.

Referring to FIG. 17, the blank 210 comprises a plurality of main panels 212, 214, 216, 218, 220, for forming walls of a carrier 290 shown in FIG. 18.

The blank 210 comprises a first securing panel 212 hingedly connected to a first end panel 214 by a hinged connection such as a fold line 213. The first end panel 214 is hingedly connected to a first side panel 216 by a hinged connection such as a fold line 215. The first side panel 216 is hingedly connected to a second end panel 218 by a hinged connection such as a fold line 217. The second end panel 218 is hingedly connected to a second side panel 220 by a hinged connection such as a fold line 219.

The blank 210 comprises a first base panel 222 hingedly connected to the first end panel 214 by a hinged connection such as a fold line 221. The blank 210 comprises a second base panel 224 hingedly connected to the first side panel 216 by a hinged connection such as a fold line 223. The blank 210 comprises a third base panel 226 hingedly connected to the second end panel 218 by a hinged connection such as a fold line 225. The blank 210 comprises a fourth base panel 228 hingedly connected to the second side panel 220 by a hinged connection such as a fold line 227.

The first, second, third and fourth base panels 222, 224, 226, 228 are configured to at least partially overlap so as to be securable together to form a collapsible composite base wall 222/224/226/228 of the set up carton 290. The first, second, third and fourth base panels 222, 224, 226, 228 are configured and arranged to be automatically erected into the composite base wall 222/224/226/228 when the carrier 290 is erected into a tubular structure.

The first base panel 222 comprises a hinged connection such as a fold line 239; the fold line 239 intersects with the fold line 221 and extends divergently away therefrom. The fold line 239 and the fold line 221 are arranged to define an angle therebetween; the angle between the fold line 239 and the fold line 221 is substantially 45 degrees.

The third base panel 226 comprises a hinged connection such as a fold line 241; the fold line 241 intersects with fold line 225 and extends divergently away therefrom. The fold line 241 and the fold line 225 are arranged to define an angle therebetween; the angle between fold line 241 and the fold line 225 is substantially 45 degrees.

The blank 210 comprises a first side wall reinforcing panel 232 hingedly connected along an upper edge of the first side wall 216 by a hinged connection such as a fold line 233.

The blank 210 comprises a second side wall reinforcing panel 236 hingedly connected along an upper edge of the second side wall 220 by a hinged connection such as a fold line 237.

The blank 210 comprises a first handle reinforcing panel 230 and a second handle-reinforcing panel 234. The first handle-reinforcing panel 230 is hingedly connected to the first end panel 214 by a hinged connection such as a fold line 231. The second handle-reinforcing panel 234 is hingedly connected to the second end panel 218 by a hinged connection such as a fold line 235.

The first end panel 214 comprises a first handle structure. The first handle structure comprises a first handle aperture A1 struck therefrom. The first handle aperture A1 is defined in part by an optional cushioning flap 240*a* which is hingedly connected to the first end panel 214 by a hinged connection such as a fold line 241*a*.

The second end panel 218 comprises a second handle structure. The second handle structure comprises a second handle aperture A2 struck therefrom. The second handle aperture A2 is defined in part by an optional cushioning flap 240*b* which is hingedly connected to the second end panel 218 by a hinged connection such as a fold line 241*b*.

The first handle reinforcing panel 230 comprises a third handle structure. The third handle structure comprises a third handle aperture A3 struck therefrom. The third handle aperture A3 is defined in part by an optional cushioning flap 240*c* which is hingedly connected to the first handle reinforcing panel 230 by a hinged connection such as a fold line 241*c*.

The second handle reinforcing panel 234 comprises a fourth handle structure. The fourth handle structure comprises a fourth handle aperture A4 struck therefrom. The fourth handle aperture A4 is defined in part by an optional cushioning flap 240*d* which is hingedly connected to the second handle reinforcing panel 234 by a hinged connection such as a fold line 241*d*.

The blank 210 comprises a first partition structure P1 and a second partition structure P2.

The first partition structure P1 comprises first partition panel 250 hingedly connected to the second handle reinforcing panel 234 by a hinged connection such as a fold line 251. The fold line 251 is interrupted by a severance line or cut line 253. The cut line 253 is substantially "U" shaped such that a portion of the second handle reinforcing panel 234 is effectively struck from the first partition panel 250. The first partition panel 250 is struck from the second handle reinforcing panel 234. The first partition structure P1 comprises a second partition panel 252 hingedly connected to the first partition panel 250 by a hinged connection such as a fold line 255. The fold line 255 is interrupted by a severance line or cut line 257. The cut line 257 is substantially "Z" shaped such that a portion of the first partition panel 250 is effectively struck from the second partition panel 252 and a portion of the second partition panel 252 is effectively struck from the first partition panel 250. The first partition structure P1 comprises a second securing panel 254; the second securing panel 254 is hingedly connected to the second partition panel 252 by a hinged connection such as a fold line 259.

The second partition structure P2 comprises a third partition panel 256 hingedly connected to the first handle reinforcing panel 230 by a hinged connection such as a fold line 261. The fold line 261 is interrupted by a severance line or cut line 263. The cut line 263 is substantially "U" shaped such that a portion of the first handle reinforcing panel 230 is effectively struck from the third partition panel 256. The third partition panel 256 is struck from the first handle reinforcing panel 230. The second partition structure P2 comprises a fourth partition panel 258 hingedly connected to the third partition panel 256 by a hinged connection such as a fold line 265. The fold line 265 is interrupted by a severance line or cut line 267. The cut line 267 is substantially or generally "Z" shaped such that a portion of the third partition panel 256 is effectively struck from the fourth partition panel 258 and a portion of the fourth partition panel 258 is effectively struck from the third partition panel 256.

The first handle reinforcing panel 230 is hingedly connected to the first side wall reinforcing panel 232 by the fold line 215; the fold line 215 is interrupted by an aperture A9 which aperture A9 is struck in part from first side wall reinforcing panel 232 and in part from the first handle reinforcing panel 230.

The second handle reinforcing panel 234 is hingedly connected to the first side wall reinforcing panel 232 by the fold line 217; the fold line 217 is interrupted by an aperture A10 which aperture A10 is struck in part from first end wall reinforcing panel 232 and in part from the second handle reinforcing panel 234.

The second handle reinforcing panel 234 is hingedly connected to the second side wall reinforcing panel 236 by the fold line 219; the fold line 219 is interrupted by an aperture A11 which aperture A11 is struck in part from second side wall reinforcing panel 236 and in part from the second handle reinforcing panel 234.

Again apertures A9, A10 and A11 reduce the amount of material that would otherwise be present at internal corners when the blank 210 is folded and formed into the carrier 290.

Turning to the construction of the carrier 290 as illustrated in FIGS. 20 to 23, the carrier 290 (see FIGS. 18 and 19) can be formed by a series of sequential folding operations in a straight line machine so that the carrier 290 is not required to be rotated or inverted to complete its construction. The folding process is not limited to that described below and may be altered according to particular manufacturing requirements.

Figure 20:
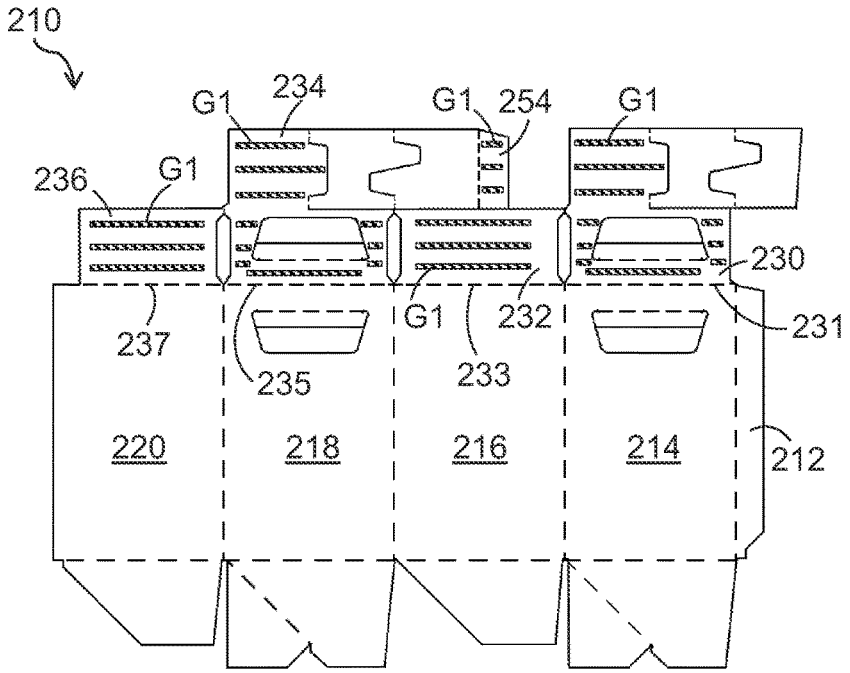
FIGS. 20 to 23 are plan views from above of stages of construction of the blank of FIG. 17.

Glue G1 or other adhesive treatment is applied to the first handle reinforcing panel 230, the first side wall reinforcing panel 232, the second handle reinforcing panel 234, the second side wall reinforcing panel 236 and the second securing panel 254, as shown in FIG. 20.

Figure 21:
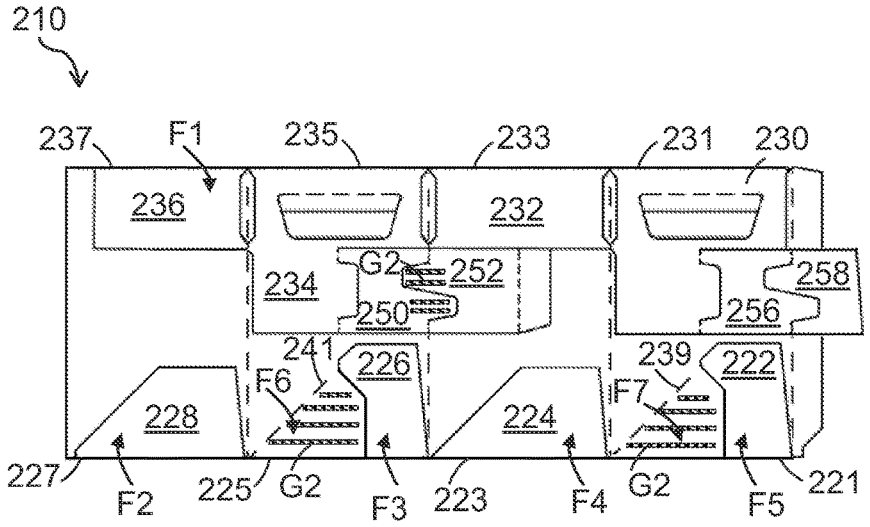

The blank 210 is folded, as shown in FIG. 21 by direction arrow F1, about the fold lines 231, 233, 235 and 237 such that the first handle reinforcing panel 230, the first side wall reinforcing panel 232, the second handle reinforcing panel 234 and the second side wall reinforcing panel 236 are folded thereabout respectively. The first handle reinforcing panel 230 is secured to the first end panel 214. The first side wall reinforcing panel 232 is secured to the first side panel 216. The second handle reinforcing panel 234 is secured to the second end panel 218. The second side wall reinforcing panel 236 is secured to the second side panel 220. Additionally, the first and second partition structures P1, P2 are brought into overlapping face contacting relationship with regions of the first securing panel 212, first end panel 214, first side panel 216 and second end panel 218 respectively. The second securing panel 254 of the first partition structure P1 is thereby affixed to the first side panel 216.

The first, second, third and fourth base panels 222, 224, 226, 228 are folded, as indicated by direction arrows F2, F3, F4, F5, about the fold lines 221, 223, 225 and 227 so as to be brought into face contacting relationship with the first end wall 214, first side wall 216, second end wall 218 and second side wall 220 respectively. The first and third base panels 222, 226 are further folded about the fold lines 239, 241. The first base panel 222 is folded upon itself as indicated by direction arrow F6. The third base panel 226 is folded upon itself as indicated by direction arrow F7.

Glue G2 or other adhesive treatment is applied to the portions of the first and third base panels 222, 226 which are folded about the fold lines 239, 241.

Glue G2 or other adhesive treatment is applied to portions of the first partition panel 250 and the second partition panel 252 adjacent to the cut line 257, at least to the portion of the first partition panel 250 struck from the second partition panel 252 and the portion of the second partition panel 252 struck from the first partition panel 250, as shown in FIG. 21.

Figure 22:
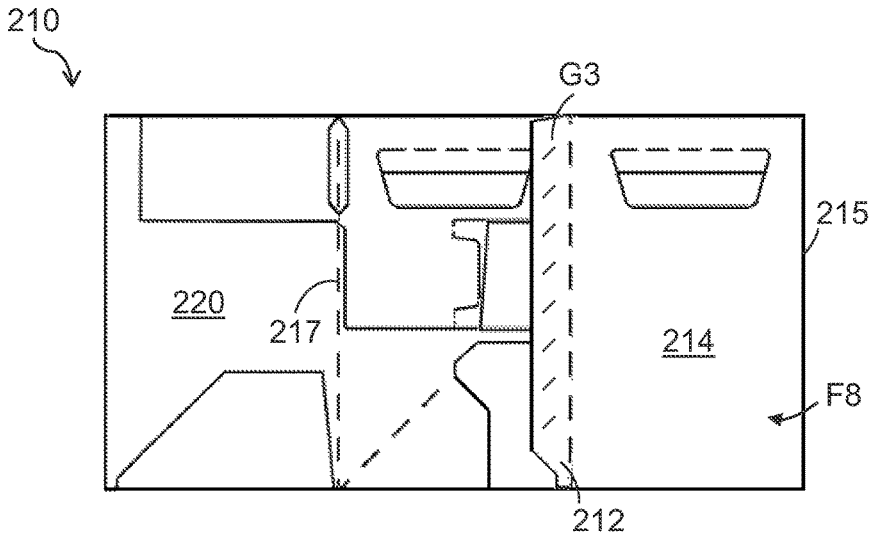

The blank 210 is folded, as indicated by direction arrow F8 in FIG. 22, about the fold line 215 such that the first end panel 214 is brought into overlying relationship with the first side panel 216 and such that the first securing panel 212 is brought into overlying relationship with the second end panel 218. In this way, the first partition panel 250 is affixed in part to the third partition panel 256; and the second partition panel 252 is affixed in part to the fourth partition panel 258.

Glue G3 or other adhesive treatment is applied to the first securing panel 212 as shown in FIG. 22.

Figure 23:
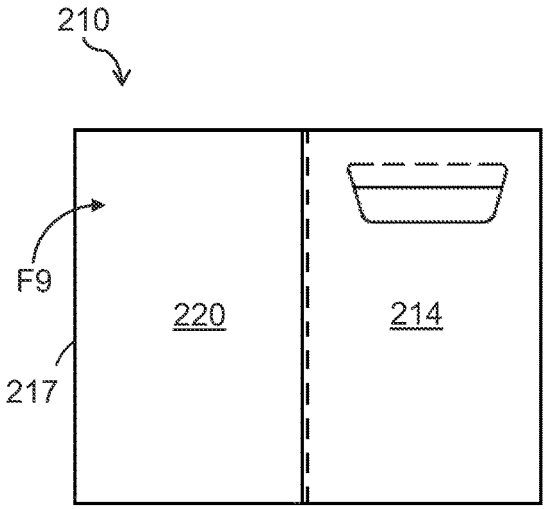
Figure 24:
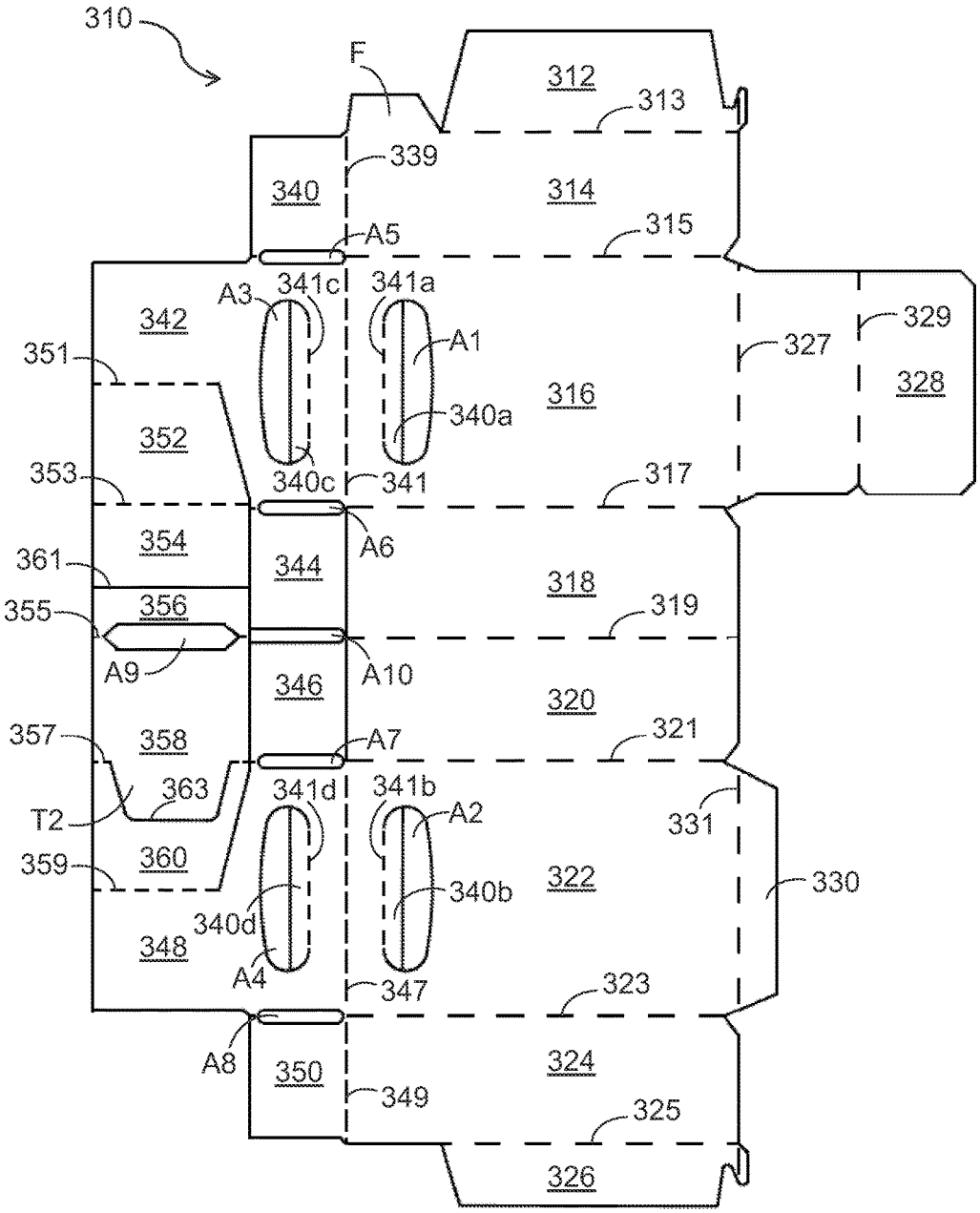
FIG. 24 is a plan view from above of a blank for forming a carrier according to a fourth embodiment.

The blank 210 is folded, as indicated by direction arrow F9 in FIG. 23, about the fold line 217 such that the second side panel 220 is brought into face contacting relationship with and is affixed to the first securing panel 212.

A flat collapsed carrier is formed as shown in FIG. 23. The flat collapsed carrier may be shipped or distributed in this flat collapsed form.

Figure 19:
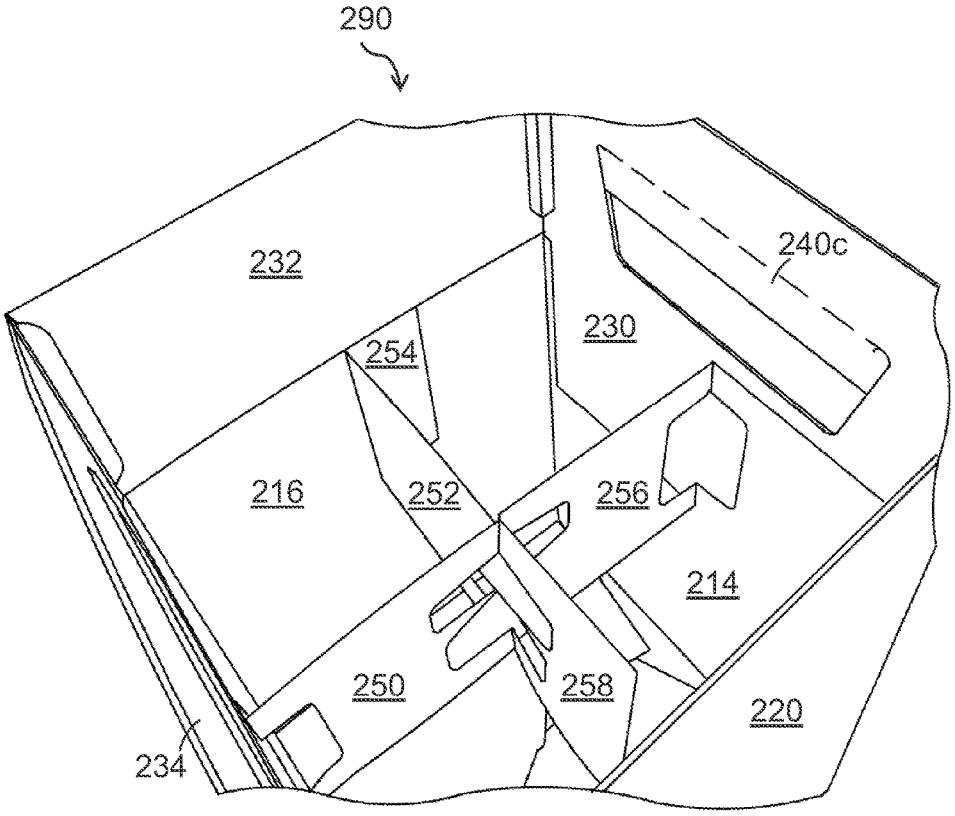
FIG. 19 is a perspective view from above of a portion of the carrier formed from the blank of FIG. 17 showing an internal cellular structure.

The flat collapsed carrier may be erected into a tubular structure by separating the first end panel 214 from the second end panel 218. In this way an open ended carrier 290 is formed and the composite base wall is automatically erected. The completed carrier 290 is illustrated in FIGS. 18 and 19. The carrier 290 has a plurality of cells each for receiving an article (not shown). The illustrated carrier 290 has four cells.

The partition structures P1, P2, are automatically erected within the carrier 290 when the flat collapsed carrier is erected.

The carrier 290, in its erected form, may be loaded with articles through open top end of the carrier 290.

The partition structures P1, P2, divide the interior space of the carrier 290 into cells, in the illustrated embodiment there are four cells arranged in a 2×2 array.

The first partition panel 250 extends from the second end panel 218 to the centre of the interior space of the carrier 290.

The second partition panel 252 extends from centre of the interior space of the carrier 290 to the first side panel 216.

The third partition panel 256 extends from the first end panel 214 to the centre of the interior space of the carrier 290.

The fourth partition panel 258 extends from the centre of the interior space of the carrier 290 towards the second end panel 220.

The first partition panel 250 and the third partition panel 256 together extend across the interior space of the carrier 290 in a first direction. The second partition panel 252 and the fourth partition panel 258 together extend partially across the interior space of the carrier 290 in a second transverse direction.

The first handle reinforcing panel 230 spaces the third partition panel 256 apart from the first side wall 216. The location of the fold line 261 determines the location of the third partition panel 256 within the carrier 90. In the illustrated embodiment the third partition panel 256 substantially bisects part of the interior space of the carrier 290 in the first direction.

The second handle reinforcing panel 234 spaces the first partition panel 250 apart from the second side wall 220. The location of the fold line 251 determines the location of the first partition panel 250 within the carrier 290. In the illustrated embodiment the first partition panel 250 substantially bisects part of the interior space of the carrier 290 in the second direction.

The portion of the first partition panel 250 that is effectively struck from the second partition panel 252 is displaced out of the plane of the second partition panel 252 and remains coplanar with the rest of first partition panel 250. In this way the first partition panel 250 extends from the first end panel 214 beyond the centre of the interior space of the carrier 290 in the first direction as shown in FIG. 19.

The portion of the third partition panel 256 that is effectively struck from the fourth partition panel 258 is displaced out of the plane of the fourth partition panel 258 and remains coplanar with the rest of third partition panel 256. In this way the third partition panel 256 extends from the second end panel 218 beyond the centre of the interior space of the carrier 290 in the first direction.

The portion of the second partition panel 252 that is effectively struck from the first partition panel 250 is displaced out of the plane of the first partition panel 250 and remains coplanar with the rest of second partition panel 252. In this way the second partition panel 252 extends from the first side panel 216 beyond the centre of the interior space of the carrier 290 in the second direction.

The portion of the fourth partition panel 258 struck from the third partition panel 256 is displaced out of the plane of the third partition panel 256 and remains coplanar with the rest of fourth partition panel 258. In this way the fourth partition panel 258 extends from the centre of the interior space of the carrier 290 towards both the first side panel 216 and the second side panel 220.

Referring now to FIGS. 24 to 31, there is shown an additional embodiment of the present disclosure. In the fourth illustrated embodiment, like numerals have, where possible, been used to denote like parts, albeit with the addition of the prefix "300" to indicate that these features belong to the fourth embodiment. The additional embodiment shares many common features with the first, second and third embodiments and therefore only the differences from the embodiments illustrated in FIGS. 1 to 23 will be described in detail.

Figure 25:
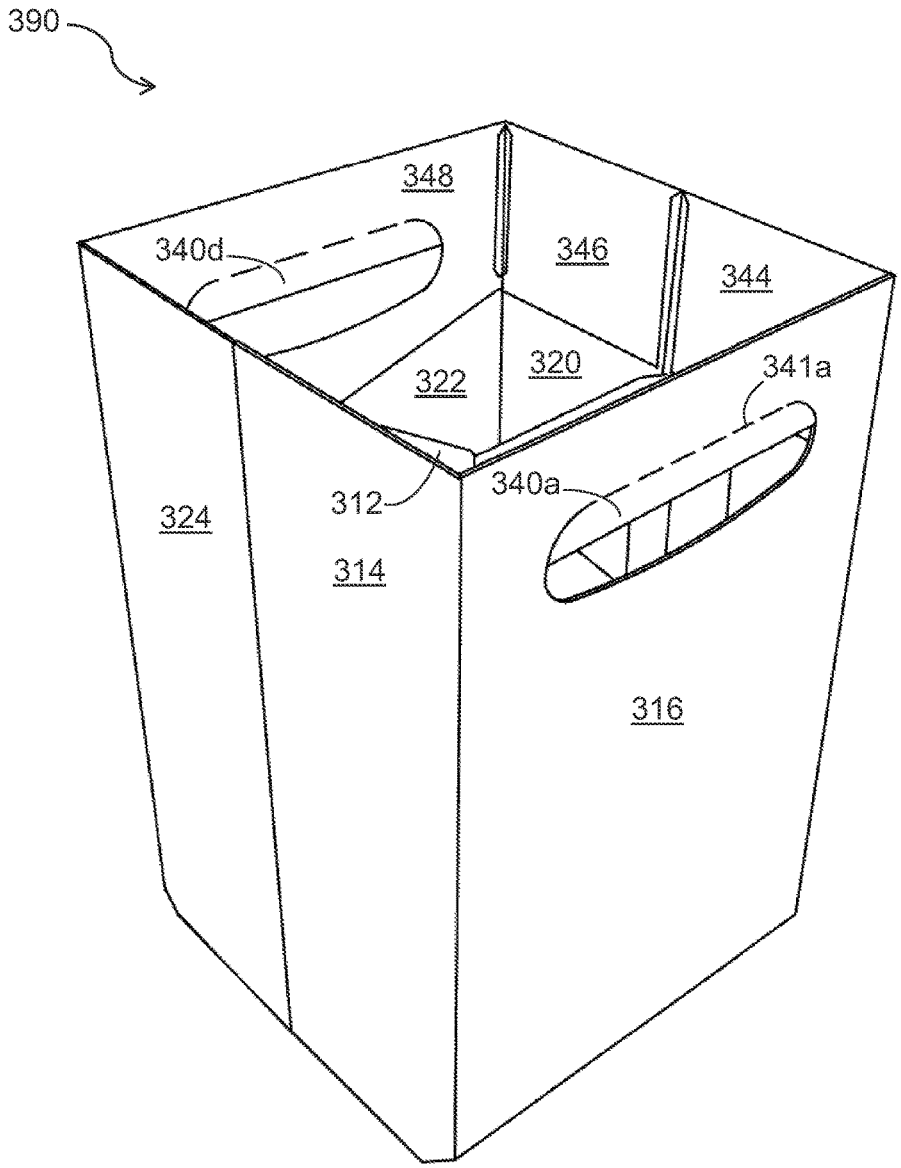
FIG. 25 is a perspective view from above of a carrier formed from the blank of FIG. 24.
Figure 26:
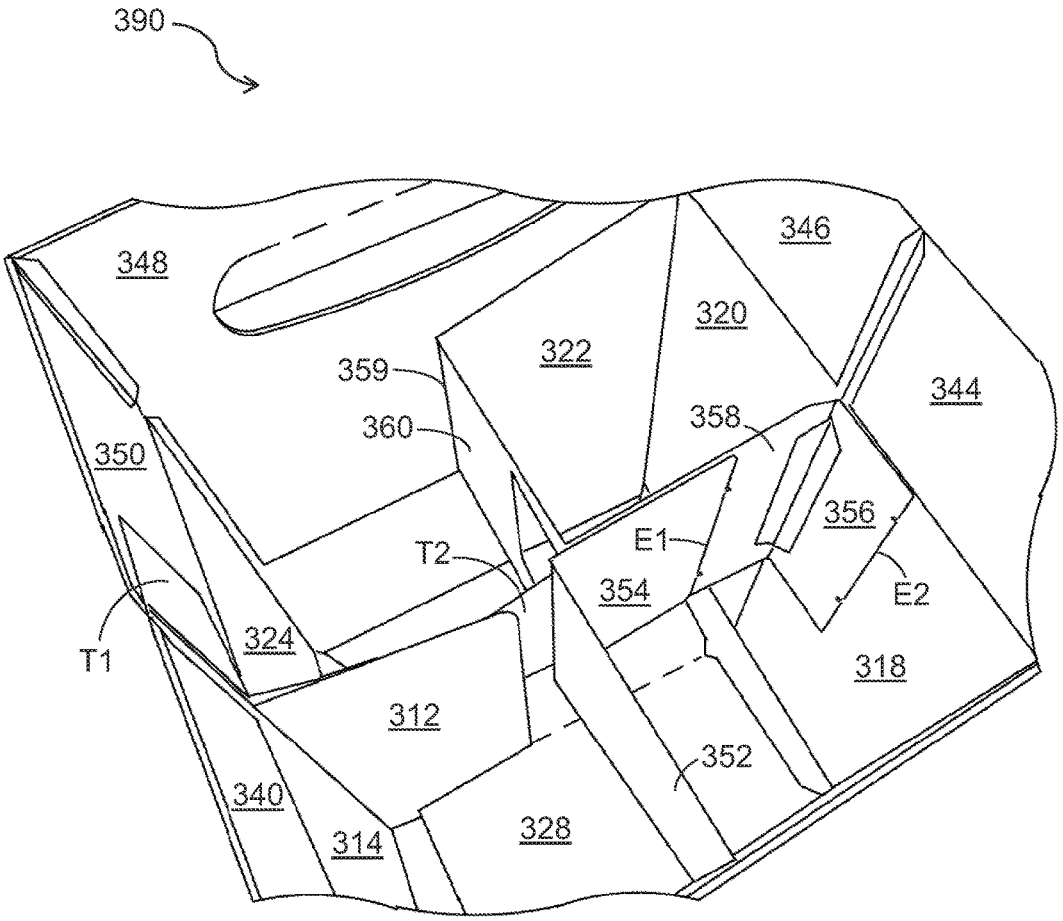
FIG. 26 is a perspective view from above of a portion of the carrier formed from the blank of FIG. 24 showing an internal cellular structure.

The blank 310 comprises a plurality of main panels 312, 314, 316, 318, 320, 322, 324, 326 for forming the walls of a carrier 390 shown in FIGS. 25 and 26. The main panels 312, 314, 316, 318, 320, 322, 324, 326 are hingedly connected one to the next in a linear series that comprises a third partition panel 312 hingedly connected to a first end panel 314 by a hinged connection such as a fold line 313. The first end panel 314 is hingedly connected to a first side panel 316 by a hinged connection such as a fold line 315. The first side panel 316 comprises a first handle structure similar to that already described above. The first side panel 316 is hingedly connected to a third end panel 318 by a hinged connection such as a fold line 317. The third end panel 318 is hingedly connected to a fourth end panel 320 by a hinged connection such as a fold line 319. Together, the third and fourth end panels 318, 320 form a second end wall 318/320 of the carrier 390, which second end wall 318/320 is foldable so that the blank 310 when part assembled, folded and glued can be collapsed into a flat form.

The fourth end panel 320 is hingedly connected to a second side panel 322 by a hinged connection such as a fold line 321. The second side panel 322 comprises a second handle structure similar to that already described above. The second side panel 322 is hingedly connected to a second end panel 324 by a hinged connection such as a fold line 323. Together, the first and second end panels 314, 324 form a first end wall 314/324 of the carrier 390, which second end wall 314/324 is foldable so that the blank 310 when part assembled, folded and glued can be collapsed into a flat form. The blank 310 also comprises a first securing panel 326 hingedly connected to the second end panel 324 by a hinged connection such as a fold line 325.

The blank 310 comprises a base panel 328 hingedly connected by a hinged connection such as a fold line 327 to a bottom or lower edge of the first side panel 316. The base panel 328 comprises a hinged connection such as a fold line 329 again for permitting the part formed blank 310 to be collapsed into a substantially flat form. A second securing panel 330 is hingedly connected by a hinged connection such as a fold line 331 to a lower edge of the second side panel 322. The second securing panel 330 is for attaching the base panel 328 to second side panel 322.

The blank 310 comprises first, second, third and fourth end wall reinforcing panels 340, 350, 344, 346. The first and second end wall reinforcing panels 340, 350 are hingedly connected along upper edges of the first and second end panels 314, 324 by the fold lines 339 and 349 respectively. The third and fourth end wall reinforcing panels 344, 346 are spaced apart from one another by an aperture A10 provided to minimize the amount of material present at a corner portion of the carrier 390 when assembled. The third and fourth end wall reinforcing panels 344, 346 are also separated from the upper edges of the third and fourth end panels 318, 320 by an optional cut line.

The blank 310 comprises a first handle reinforcing panel 342 and a second handle-reinforcing panel 348. The first handle-reinforcing panel 342 is hingedly connected to an upper edge of the first side panel 316 by a hinged connection such as a fold line 341. The second handle-reinforcing panel 348 is hingedly connected to an upper edge of the second side panel 322 by a hinged connection such as a fold line 347.

The first side panel 316 comprises a first handle structure. The first handle structure comprises a first handle aperture A1 struck therefrom. The first handle aperture A1 is defined in part by an optional cushioning flap 340*a* which is hingedly connected to the first side panel 316 by a hinged connection such as a fold line 341*a*. Similarly, the second side panel 322 comprises a second handle structure 341*b*/340*b*/A2.

The first handle reinforcing panel 342 comprises a third handle structure 341*c*/340*c*/A3, that comprises a third handle aperture A3 that is defined in part by an optional cushioning flap 340*c* which is hingedly connected to the first handle reinforcing panel 342 by a hinged connection such as a fold line 341*c*. Similarly, the second handle reinforcing panel 348 comprises a fourth handle structure 341*d*/340*d*/A4.

The blank 310 comprises a first partition structure, a second partition structure and a third partition structure. The first partition structure comprises first partition panel 352 hingedly connected to the first handle reinforcing panel 342 by a hinged connection such as a fold line 351. The first partition panel 352 may be considered as effectively being struck from the first handle reinforcing panel 342. The first partition structure comprises a third securing panel 354; the third securing panel 354 is hingedly connected to the first partition panel 352 by a hinged connection such as a fold line 353.

The second partition structure comprises a second partition panel 360 hingedly connected to the second handle reinforcing panel 348 by a hinged connection such as a fold line 359. The second partition panel 360 may be considered as effectively being struck from the second handle reinforcing panel 348. The second partition structure comprises a fourth securing panel 358/356 which is interrupted by an aperture A9 so that the fourth securing panel 358/356 can optionally, extend around an internal corner of the carrier 390 (see FIG. 26). The fourth securing panel 358/356 may be considered as having two parts: a first part 358; and a second part 356. The first part 358 of the fourth securing panel 358/356 is hingedly connected to the second partition panel 360 by a hinged connection such as a fold line 357. The fold line 357 is interrupted by a severance line or cut line 363 that is substantially "U" shaped such that a portion or tab T2 of the first part 358 of the fourth securing panel 358/356 is struck from the second partition panel 360. The second part 356 is separated from adjacent third securing panel 354 by a severance line or cut line 361. The first and second parts 358, 356 of the fourth securing panel 356, 358 are hingedly connected together by the fold line 355 which is interrupted by the aperture A9.

The third partition structure comprises the tab T2, which acts as a fifth securing panel T2; and the third partition panel 312.

Apertures A5, A6, A7, A8, A9 and A10 are all provided, as already described, to reduce the amount of material present at internal corners to prevent bunching or creasing of material.

Turning to the construction of the blank 310 into a carrier 390 as illustrated in FIGS. 27 to 31, the carrier 390 (see FIGS. 25 and 26) can be formed by a series of sequential folding operations in a straight line machine so that the carrier 390 is not required to be rotated or inverted to complete its construction. The folding process is not limited to that described below and may be altered according to particular manufacturing requirements.

Figure 27:
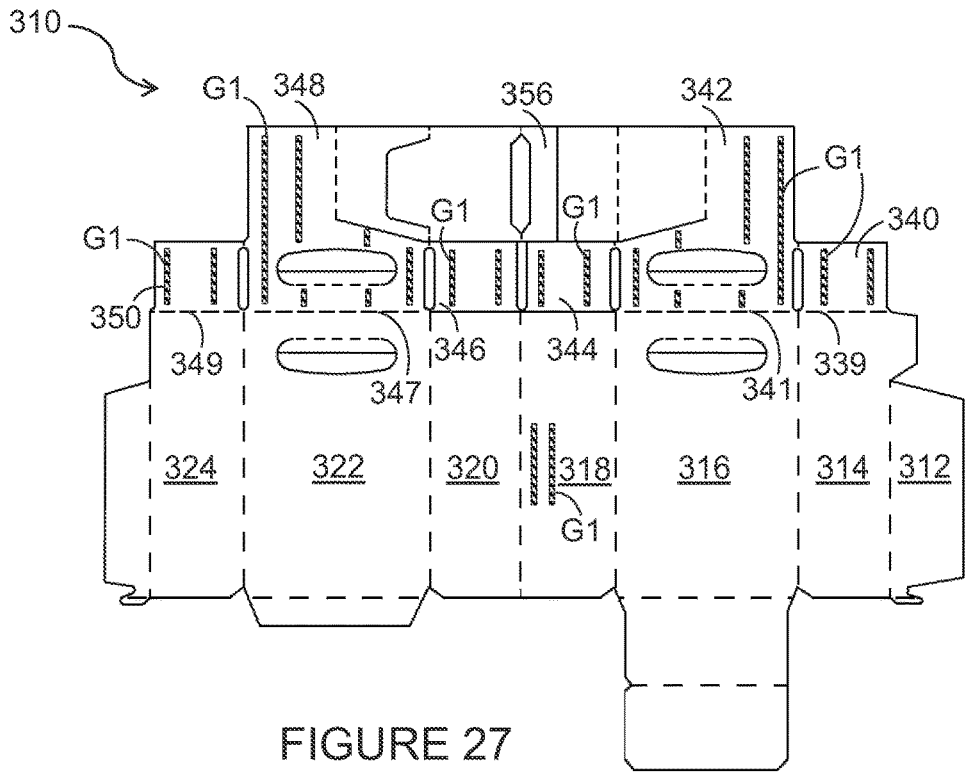
FIGS. 27 to 31 are plan views from above of stages of construction of the blank of FIG. 24.

Glue G1 or other adhesive treatment is applied to the first, second, third and fourth end wall reinforcing panels 340, 350, 344, 346 and to the first and second handle reinforcing panels 342, 348, as shown in FIG. 27. Additionally glue G1 or other adhesive treatment is applied to a region of the third end panel 318.

Figure 28:
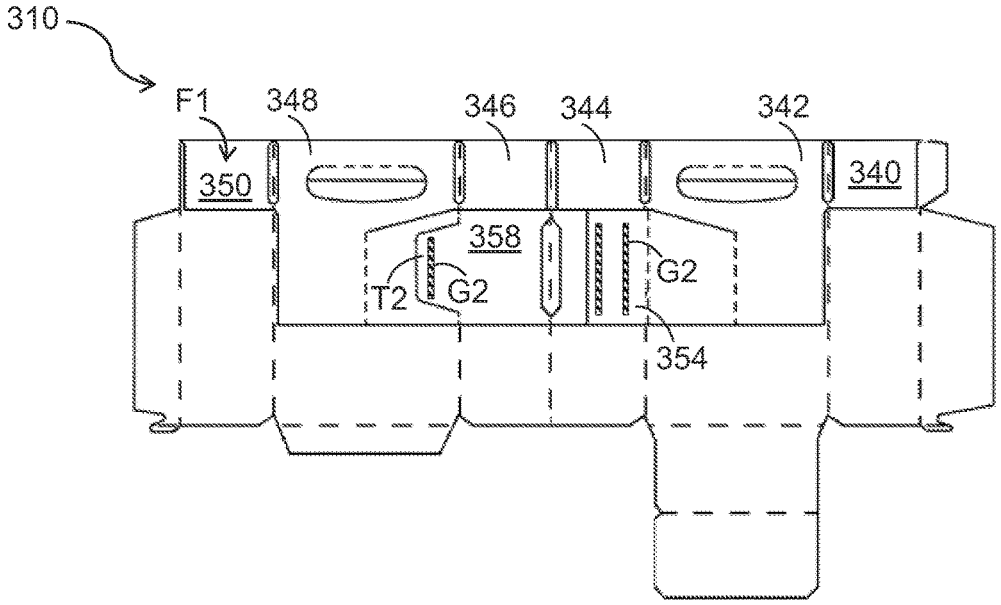

The blank 310 is folded, as shown in FIG. 28 by direction arrow F1, about the fold lines 339, 341, 347 and 349, such that the first end wall reinforcing panel 340 is disposed in face contacting relationship and is secured to the first end panel 314. The first handle reinforcing panel 342 and the first partition panel 352 are brought into face contacting relationship with the first side panel 316, and the first handle reinforcing panel 342 is secured thereto. The third and fourth end wall reinforcing panels 344, 346 and third and fourth securing panels 354, 358/356 are brought into face contacting relationship with an inside surface of the third or fourth end panel 318, 320 respectively and the third and fourth end wall reinforcing panels 344, 346 are secured to the third or fourth end panel 318, 320 respectively. The second part 356 of the fourth securing panel 358/356 is affixed to the third end panel 318.

Additionally, the second handle reinforcing panel 348 and the second partition panel 360 are brought into face contacting relationship with the second side wall 322 and the second handle reinforcing panel 348 is secured thereto. The second end wall reinforcing panel 350 is brought into face contacting relationship and is secured to the second end panel 324.

Glue G2 or other adhesive treatment is applied to regions of the outside surfaces of tab T2 and third securing panel 354 as shown in FIG. 28.

Figure 29:
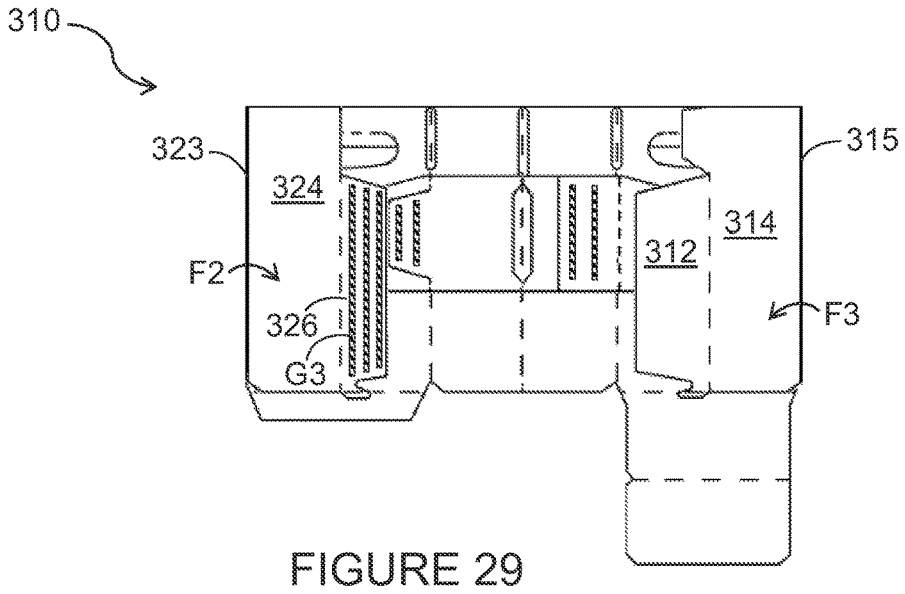

The blank 310 is folded, as indicated by direction arrows F2 and F3 in FIG. 29, about the fold lines 323 and 315. In this way, the second end panel 324 and first securing panel 326 are brought into overlying relationship with the second side panel 322; and the first end panel 314 and third partition panel 312 are brought into overlying relationship with the first side panel 316.

Glue G3 is applied to regions of the outside surface of first securing panel 326 as shown in FIG. 29.

Figure 30:
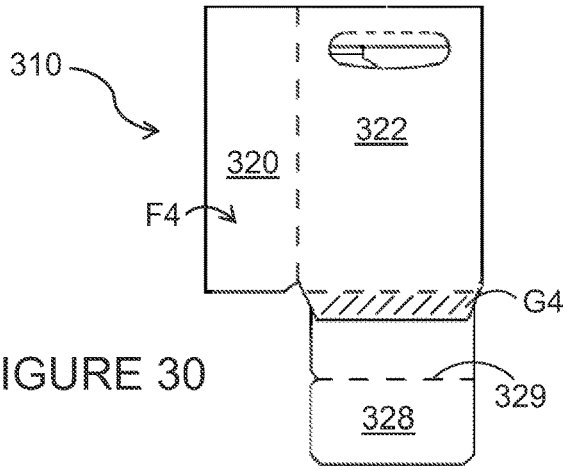

The blank 310 is then folded again, as indicated by direction arrow F4 in FIG. 30, about the fold line 319 such that the tab T2 is secured to the third partition panel 312; and such that the first securing panel 326 is affixed to the first end panel 314.

Figure 31:
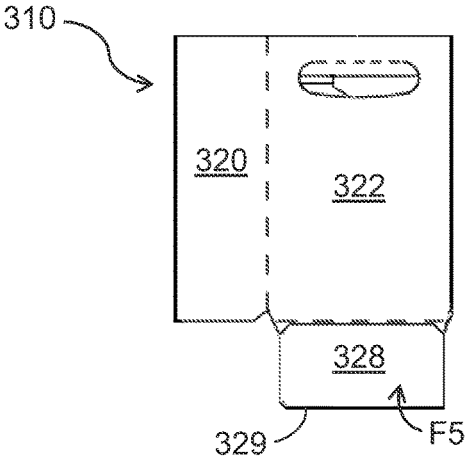

Adhesive G4 is applied to the second securing panel 330 as shown in FIG. 30, and the base panel 328 is folded about the fold line 329, as indicated by arrow F5 in FIG. 31.

A flat collapsed carrier is formed as shown in FIG. 31. The flat collapsed carrier may be shipped or distributed in this flat collapsed form.

The flat collapsed carrier may be erected into a tubular structure by separating the second side panel 322 from the first side panel 316. In this way a carrier 390 is formed and the base wall is automatically erected. The completed carrier 390 is illustrated in FIGS. 25 and 26. The carrier 390 again has a plurality of cells each for receiving an article (not shown). The illustrated carrier 290 has four cells.

The first, second and third partition structures are automatically erected within the carrier 390 when the flat collapsed carrier is erected.

The carrier 390, in its erected form, may be loaded with articles through open top end of the carrier 390.

The first, second and third partition structures divide the interior space of the carrier 390 into cells; in the illustrated embodiment there are four cells arranged in a 2×2 array. See FIG. 26.

When the carrier 390 is erected into a tubular structure the severance line 361 is severed as a consequence of the erection process. The severance line 361 is torn or separated to create a first torn edge along an end edge E1 of the third securing panel 354 and a second torn edge along an end edge E2 of the second part of the fourth securing panel 356.

The first partition panel 352 extends from the first side panel 316 to the centre of the interior space of the carrier 390.

The second partition panel 360 extends from the second side panel 322 to the centre of the interior space of the carrier 390.

The third partition panel 312 extends from the first end wall 314/324 towards the centre of the interior space of the carrier 390.

The first part 358 of the fourth securing panel 358/356 extends from the second end wall 318/320 to the centre of the interior space of the carrier 390.

The third securing panel 354 is folded substantially perpendicularly to the first partition panel 352 and is secured to the first part 358 of the fourth securing panel 358/356.

The first part 358 of the fourth securing panel 358/356 is folded substantially perpendicularly to the second partition panel 360.

The tab T2 is displaced out of the plane of the second partition panel 360 so as to be coplanar with the first part 358 of the fourth securing panel 358/356. The tab T2 is secured to the third partition panel 312. The third partition panel 312, tab T2 and first part 358 of the fourth securing panel 358/356 along with the third securing panel 354 serve to segregate the interior space of the carrier 390 in a first direction.

The first partition panel 352 and the second partition panel 360 segregate the interior space of the carrier 390 in a second, transverse direction.

The first partition panel 352 is supported at one end by the first handle reinforcing panel 342. The second partition panel 360 is supported at one end by the second handle reinforcing panel 348. As such a further embodiment of flat-foldable crate-style carrier having automatically erectable partition structures is shown.

It can be appreciated that various changes may be made within the scope of the present invention. For example, the size and shape of the panels and apertures may be adjusted to accommodate articles of differing size or shape.

It will be recognised that as used herein, directional references such as "top", "bottom", "base", "front", "back", "end", "side", "inner", "outer", "upper" and "lower" do not necessarily limit the respective panels to such orientation, but may merely serve to distinguish these panels from one another.

As used herein, the terms "hinged connection" and "fold line" each refers to all manner of lines that define hinge features in a substrate of sheet material, for facilitating folding portions of the substrate with respect to one another, or otherwise for indicating optimal folding locations in the substrate. For example, a hinged connection should not be construed as necessarily referring to a single fold line only: indeed a hinged connection can be formed from one or more fold lines. A fold line may be, but not limited to, a single score line, a single half cut, a line of perforations, a line of short slits (i.e., an interrupted slit), a line of half-cuts, a line of cuts (i.e., an interrupted cut line), a series of short score lines (i.e., an interrupted score line), any combination thereof or the like.

As used herein, the terms "severance line" and "frangible line" each refers to all manner of lines formed in a substrate of sheet material, that facilitate separating portions of the substrate from one another, or otherwise indicate optimal separation locations on the substrate. For example, a severance line or frangible line in a substrate of sheet material is predisposed to allow a tear to propagate there-along. A severance line or frangible line may be a weakened line which includes, but not limited to, a single cut, a single slit, a single half cut, a line of perforations, a line of short slits (i.e., an interrupted slit), a line of half-cuts, a line of cuts (i.e., an interrupted cut line), a series of short score lines (i.e., an interrupted score line), any combination thereof or the like. The elements of a fold line or severance line (such as cuts, scores and half cuts) may be dimensioned and arranged to provide the desired functionality.

It should be understood that hinged connection, severance lines, frangible lines and fold lines can each include elements that are formed in the substrate of the blank including perforations, a line of perforations, a line of short slits, a line of half-cuts, a single half-cut, a cut line, an interrupted cut line, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking to provide a fold line, to facilitate folding and facilitate breaking with more effort to provide a severable or frangible fold line, or to facilitate breaking with little effort to provide a severance line.

The phrase "in alignment with" as used herein refers to alignment of two or more elements in an erected carrier, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

As used herein the term "aperture" refers to all manner of shapings, recesses, notches, openings, cuts, slots, holes and gaps which may be circular, rectangular, capsule shaped, irregular shaped and many other shapes that are pre-formed or pre-defined.

The invention claimed is:

1. A carrier for packaging a plurality of articles, the carrier being formed from a single unitary blank, the carrier comprising:

a plurality of primary panels hingedly connected together to form a tubular structure having an interior space, at least one of the primary panels having a handle;

a bottom closure structure for at least partially closing a lower end of the tubular structure;

at least one handle reinforcing panel secured to the inside surface of the at least one of the primary panels; and at least one partition structure hingedly connected directly to the at least one handle reinforcing panel and disposed in the tubular structure to divide the interior space of the tubular structure into two or more cells for receiving articles;

wherein the at least one handle reinforcing panel is hingedly connected directly to the at least one of the primary panels;

wherein the at least one handle reinforcing panel comprises first and second handle reinforcing panels, the at least one of the primary panels comprises a first one of the primary panels and a second one of the primary panels, and wherein the first and second handle reinforcing panels are hingedly connected to the first and second ones of the primary panels respectively.

2. The carrier according to claim 1 wherein the at least one partition structure comprises first and second partition structures, and the first partition structure is hingedly connected to the first handle reinforcing panel and divides the interior space of the tubular structure in a first direction.

3. The carrier according to claim 2 wherein the second partition structure is hingedly connected to the second handle reinforcing panel and divides the interior space of the tubular structure in the first direction.

4. The carrier according to claim 3 wherein the at least one partition structure further comprises a third partition structure which divides the interior space of the tubular structure in a second direction, the second direction being substantially perpendicular to the first direction.

5. The carrier according to claim 4 wherein the first and second partition structures are secured to the third partition structure.

6. The carrier according to claim 1 wherein the at least one partition structure is automatically erected within the carrier in response to erecting the carrier into a tubular structure.

7. The carrier according to claim 1 wherein the unitary blank is formed from a foldable material.

8. The carrier according to claim 1 wherein the at least one partition structure is struck at least in part from the at least one handle reinforcing panel.

9. The carrier according to claim 1 wherein the handle in the at least one of the primary panels is defined at least in part by a cushioning flap struck from, and hingedly connected to, the at least one of the primary panels upon displacement of the cushioning flap out of the plane of the at least one of the primary panels.

10. A single unitary blank for forming a carrier, the blank comprising:

an elongate medial section having an axis of elongation and including a plurality of primary panels hingedly connected together for forming a tubular structure, at least one of the primary panels having a handle;

a first exterior section disposed alongside the medial section and including at least one base panel for at least partially closing a lower end of the tubular structure; and a second exterior section disposed alongside the medial section such that the medial section is disposed between the first and second exterior sections, the second exterior section including at least one handle reinforcing panel for being secured to the inside surface of the at least one of the primary panels and at least one partition structure hingedly connected directly to the at least one handle reinforcing panel for placement in the tubular structure so as to divide an interior space of the tubular structure into two or more cells for receiving articles when the blank is assembled into a carrier, wherein the at least one handle reinforcing panel is hingedly connected directly to the at least one of the primary panels;

wherein the at least one handle reinforcing panel comprises first and second handle reinforcing panels, the at least one of the primary panels comprises a first one of the primary panels and a second one of the primary panels, and the first and second handle reinforcing panels are hingedly connected to the first and second ones of the primary panels respectively.

11. The blank according to claim 10 wherein the handle in the at least one of the primary panels is defined at least in part by a cushioning flap struck from, and hingedly connected to, the at least one of the primary panels upon displacement of the cushioning flap out of the plane of the at least one of the primary panels.

12. The blank according to claim 10 wherein the at least one partition structure comprises first and second partition structures, the first partition structure is hingedly connected to the first handle reinforcing panel and divides the interior space of the tubular structure in a first direction.

13. The blank according to claim 12 wherein the second partition structure is hingedly connected to the second handle reinforcing panel and divides the interior space of the tubular structure in the first direction.

14. The blank according to claim 13 wherein the at least one partition structure further comprises a third partition structure which divides the interior space of the tubular structure in a second direction, the second direction being substantially perpendicular to the first direction.

15. The blank according to claim 14 wherein the first and second partition structures are secured to the third partition structure.

16. The blank according to claim 10 wherein the at least one partition structure is struck at least in part from the at least one handle reinforcing panel.

* * * * *